US008899723B2

(12) United States Patent
Suzuki et al.

(10) Patent No.: US 8,899,723 B2
(45) Date of Patent: Dec. 2, 2014

(54) WASTE LIQUID CONTAINER AND IMAGE FORMING APPARATUS

(75) Inventors: Kazuki Suzuki, Kanagawa (JP); Shigeyuki Ito, Aichi (JP)

(73) Assignee: Ricoh Company, Ltd., Tokyo (JP)

( * ) Notice: Subject to any disclaimer, the term of this patent is extended or adjusted under 35 U.S.C. 154(b) by 1144 days.

(21) Appl. No.: 12/170,147

(22) Filed: Jul. 9, 2008

(65) Prior Publication Data

US 2009/0015632 A1 Jan. 15, 2009

(30) Foreign Application Priority Data

Jul. 13, 2007 (JP) ..... 2007-184044

(51) Int. Cl.
*B41J 2/165* (2006.01)
*B41J 2/185* (2006.01)

(52) U.S. Cl.
USPC ..... 347/36; 347/90

(58) Field of Classification Search
CPC ..... B41J 2/1721
USPC ..... 347/36, 90, 84–91
See application file for complete search history.

(56) References Cited

U.S. PATENT DOCUMENTS

| | | | | |
|---|---|---|---|---|
| 6,312,094 | B1 | 11/2001 | Ito et al. | |
| 7,222,935 | B2 * | 5/2007 | Ono | 347/36 |
| 2004/0075712 | A1 | 4/2004 | Ono | |
| 2005/0146554 | A1 | 7/2005 | Asanuma et al. | |
| 2005/0194730 | A1 | 9/2005 | Nishida et al. | |

FOREIGN PATENT DOCUMENTS

| | | |
|---|---|---|
| EP | 0894629 A1 | 2/1999 |
| JP | 8-197749 | 8/1996 |
| JP | 8-267781 | 10/1996 |
| JP | 8-290581 | 11/1996 |
| JP | 2000-85143 | 3/2000 |
| JP | 2000-141704 | 5/2000 |
| JP | 2001-310487 | 11/2001 |
| JP | 2003-11394 | 1/2003 |
| JP | 2004-130701 | 4/2004 |
| JP | 2004-136550 | 5/2004 |
| JP | 2006-7640 | 1/2006 |
| JP | 2006-137079 | 6/2006 |
| JP | 2006-159465 | 6/2006 |
| JP | 3818361 | 6/2006 |
| JP | 2006-281508 | 10/2006 |
| JP | 2007-76308 | 3/2007 |
| JP | 2007-125812 | 5/2007 |
| JP | 2007-160871 | 6/2007 |

OTHER PUBLICATIONS

Jun. 29, 2009 European search report in connection with a counterpart European patent application No. 08 25 2330.
Nov. 15, 2011 Japanese official action in connection with a counterpart Japanese patent application.
May 29, 2012 Japanese official action in connection with a counterpart Japanese patent application.

* cited by examiner

*Primary Examiner* — Jerry Rahll
(74) *Attorney, Agent, or Firm* — Cooper & Dunham LLP

(57) ABSTRACT

A waste liquid container for storing a waste liquid discharged from an image forming apparatus is disclosed that includes a first container having a single waste liquid inlet into which the waste liquid enters and a second container communicating with the first container. The first and second containers are detachably attached to each other.

7 Claims, 22 Drawing Sheets

$$\text{ELECTROSTATIC CAPACITANCE [F]} = \frac{\text{DIELECTRIC CONSTANT OF MATERIAL} \times \text{AREA OF ELECTRODE [m}^2\text{]}}{\text{DISTANCE BETWEEN ELECTRODES [m]}}$$

WASTE LIQUID CONTAINER AND IMAGE FORMING APPARATUS

BACKGROUND

1. Technical Field

This disclosure relates to a waste liquid container and an image forming apparatus.

2. Description of the Related Art

As for known image forming apparatuses, there are printers, facsimile machines, copiers, and multi-function machines. One example of such image forming apparatuses is a liquid jet recording apparatus (e.g., inkjet recording apparatus). The liquid jet recording apparatus performs an image forming (also referred to as "recording", "printing" and the like) operation by using a recording head that ejects droplets of recording liquid (ink droplets) to a medium (e.g., paper, OHP sheet, also referred to as "recording medium") onto which the ejected liquid droplets can adhere. The liquid jet recording apparatus includes, for example, a serial type image forming apparatus that forms images by ejecting liquid droplets while moving the recording head in a main scanning direction or a line type image forming apparatus that forms images by ejecting liquid droplets without moving the recording head.

It is to be noted that the medium on which liquid is ejected from the image forming apparatus includes materials such as paper, string, fiber, fabric, leather, metal, plastic, glass, wood, and ceramic. Furthermore, the term "image formation" not only includes forming images that have a meaning (e.g., letters, shapes) on a medium but also includes forming images having no particular meaning (e.g., patterns). Furthermore, the term "liquid" not only includes recording liquid and ink, but also includes any liquid which can be used to form images. Furthermore, the term "liquid jetting apparatus" includes an apparatus that ejects liquid from a liquid jet head.

The image forming apparatus including the liquid jetting apparatus may be provided with a maintenance/recovery mechanism for maintaining/recovering the performance of a recording head from which liquid (e.g., ink) is ejected. The maintenance/recovery mechanism seals a nozzle plane (plane of the recording head in which nozzles are formed) of the recording head with a cap member and connects the cap member to an absorbing pump having a pumping tube, and drives the absorbing pumping, to thereby forcibly discharge ink from the nozzles of the recording head. Furthermore, the maintenance/recovery mechanism performs blank ejection for ejecting ink droplets that do not contribute to image formation.

By operating the maintenance/recovery mechanism, waste liquid not contributing to image formation is discharged to a waste liquid container provided in the image forming apparatus for storing the waste liquid (also referred to as "waste liquid containing unit", "waste liquid tank", and "waste ink tank"). The image forming apparatus stops operations when the waste liquid container is full or nearly full.

As a waste liquid container according to a related art example, Japanese Registered Patent No. 85143 (hereinafter referred to as "Patent Document 1") discloses a waste liquid container including a reservoir area for storing waste ink, an ink receiving area for receiving waste ink discharged from a pumping apparatus and guiding the waste ink to the reservoir area, a non-reservoir area situated next to the ink receiving area for removing the waste liquid, a first ink absorbing member provided in the ink receiving area for absorbing waste ink, and a second ink absorbing member provided in the reservoir area for absorbing waste ink.

Japanese Laid-Open Patent Application No. 2006-137079 (hereinafter referred to as "Patent Document 2") discloses a waste liquid container for containing waste liquid by separately containing accumulated matter and liquid matter included in the waste liquid. This container is provided with a notch part and a space into which the waste liquid is introduced. The accumulated matter is contained in the space, and the liquid matter is absorbed by an absorbing member.

Furthermore, Japanese Laid-Open Patent Application No. 2000-85143 (hereinafter referred to as "Patent Document 3") discloses a waste ink tank able to detect whether the waste ink tank is full. This waste ink tank has a waste ink inlet at one end of an upper wall of the waste ink tank and a detection window at the other end. A white sponge and an optical detection sensor are provided at a lower part of the detection window for detecting whether the optical reflectance of the sponge is equal to or less than a predetermined value as the color of the sponge changes to black as the waste ink is absorbed by the white sponge. The waste ink tank detects that the tank is full when hardly any light is incident on the optical sensor.

Furthermore, Japanese Laid-Open Patent Application No. 2000-141704 (hereinafter referred to as "Patent Document 4") discloses a waste ink collecting mechanism having a part for counting the number of times performing a maintenance operation. Accordingly, it is determined whether a tank is full by estimating the amount of waste ink based on the counted results and comparing the estimated amount with a predetermined amount.

Furthermore, Japanese Laid-Open Patent Application No. 2004-136550 (hereinafter referred to as "Patent Document 5") discloses an inkjet recording apparatus that determines whether a waste ink tank is full by estimating the total amount of waste ink discharged to the waste ink tank and comparing the estimated total amount with a reference value that is increased along with the passing of time.

Furthermore, Japanese Laid-Open Patent Application No. 2006-159465 (hereinafter referred to as "Patent Document 6") discloses an image forming apparatus including a waste liquid container configured to store accumulated ink in the vicinity of a waste liquid inlet and absorb liquid waste ink by providing an absorbing member at areas other than the vicinity of the waste liquid inlet. The image forming apparatus detects whether its tank is full by detecting the accumulated ink by calculating the number of times performing a maintenance operation and comparing the calculation results with a reference value.

Since the waste liquid containers disclosed in Patent Documents 2 and 6 are configured having a thin waste liquid containing space and a thick waste liquid containing space divided by a partitioning plate or an absorbing member, replacement of the container may be required when one of the spaces become full even if there is still room available for containing waste liquid in the other one of the spaces.

As described in Patent Documents 2 and 6, pigment type ink has higher viscosity and loses fluidity (due to evaporation of its solvent) faster compared to a typical dye type ink. Therefore, in a case where the pigment type ink is discharged into the waste liquid container, the pigment type ink loses fluidity and accumulates in the vicinity of the inlet of the waste liquid container. In a case where there is such an accumulation of waste liquid, the waste ink tank disclosed in Patent Document 3 configured to determine whether its tank is full on the premise that the waste ink has fluidity may be unable to determine that its tank is full due to the accumulated waste liquid overflowing from its waste liquid inlet.

Furthermore, with the waste liquid containers disclosed in Patent Documents 4 through 6, each of which determines whether its tank is full by estimating the amount of waste liquid by comparing it with a predetermined threshold, the precision of the determination largely differs depending on the precision of the calculating part (threshold value) since determination is made without measuring the actual amount of waste ink. Therefore, in a case where the criterion for the determination is assumed with a high safety margin, the tank may be determined as being full at an early stage even if there is still sufficient room available for containing the waste liquid. As a result, the waste container cannot be sufficiently used (short service life). On the other hand, overflow of the waste liquid may occur in a case where the criterion for the determination is assumed with a low safety margin or a case where the waste liquid tank is used under conditions (environment) different from the conditions assumed for obtaining the threshold value.

BRIEF SUMMARY

In an aspect of this disclosure, there is provided a waste liquid container for storing a waste liquid discharged from an image forming apparatus, the waste liquid container including a first container having a single waste liquid inlet into which the waste liquid enters, and a second container communicating with the first container, wherein the first and the second containers are detachably attached to each other.

In another aspect, there is provided an image forming apparatus including an image forming part for performing image formation, a discharging part for discharging a waste liquid that does not contribute to image formation, and a waste liquid container for storing the waste liquid discharged from the discharging part, the waste liquid container including a first container having a single waste liquid inlet into which the waste liquid enters, and a second container communicating with the first container, wherein the first and the second containers are detachably attached to each other.

Other aspects, features and advantages will become more apparent from the following detailed description when read in conjunction with the accompanying drawings.

DETAILED DESCRIPTION OF THE PREFERRED EMBODIMENTS

Figure 1:
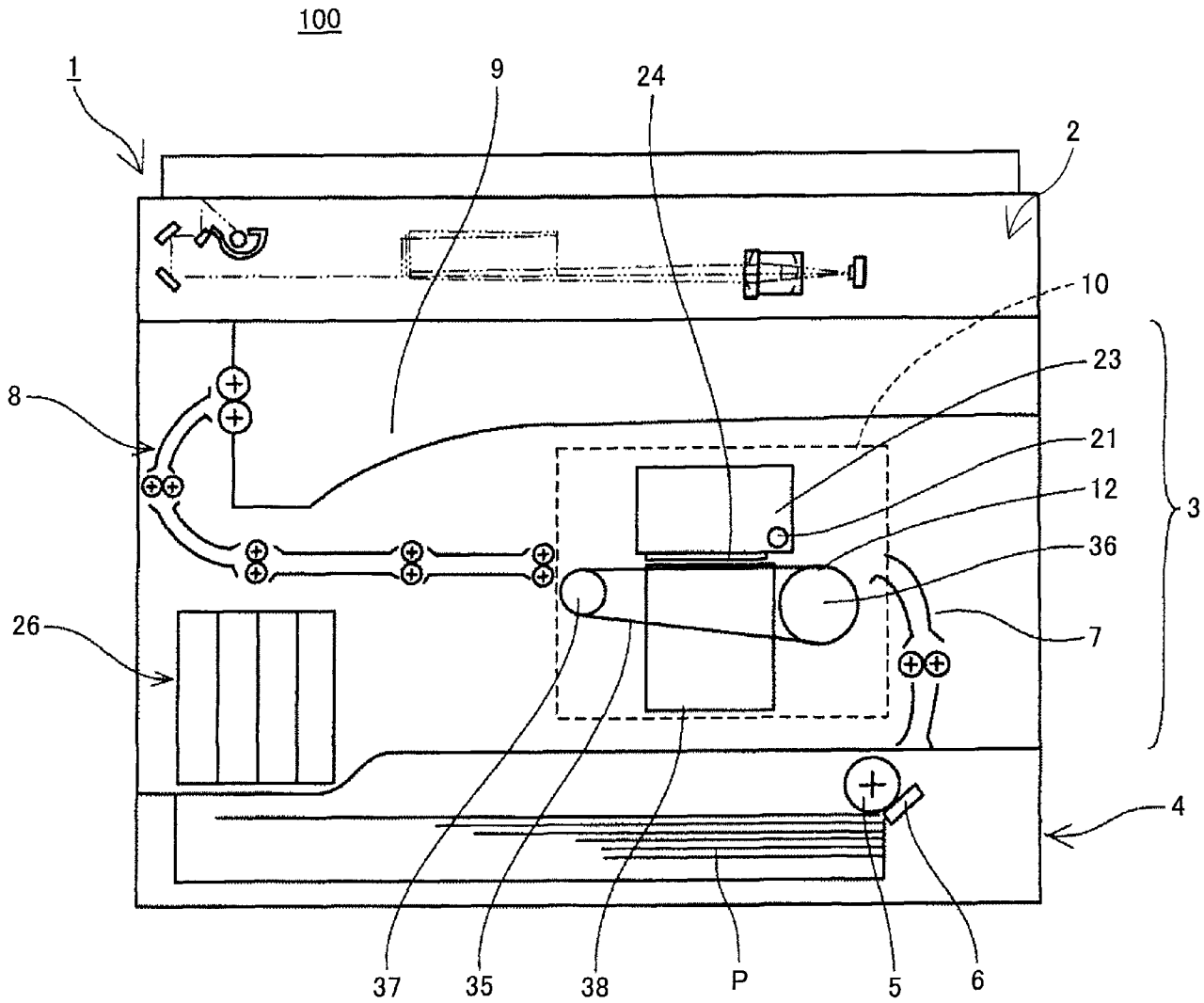
FIG. 1 is a schematic view showing an overall configuration of an image forming apparatus according to an embodiment of the present invention.
Figure 2:
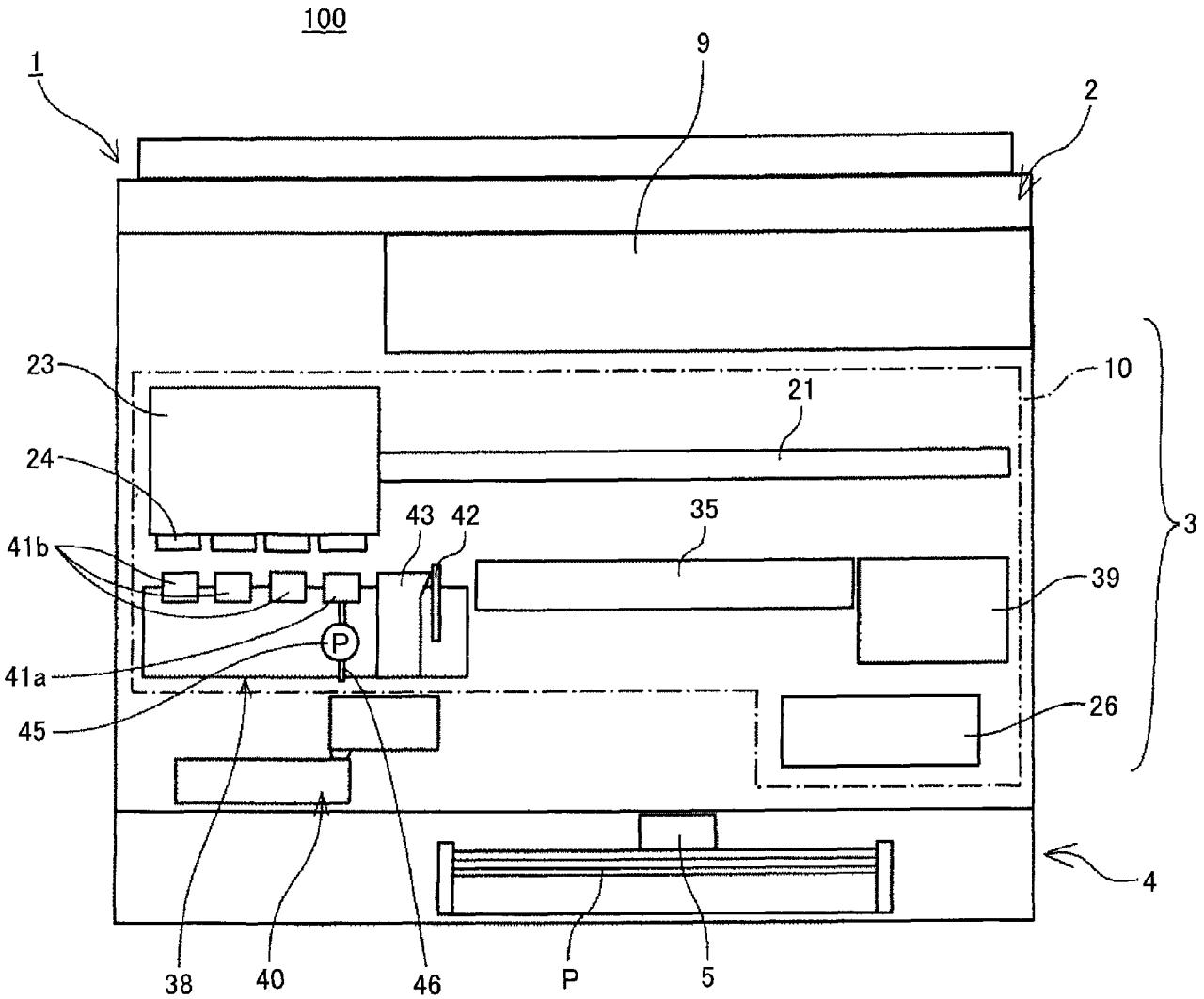
FIG. 2 is a right side view of the image forming apparatus shown in FIG. 1.
Figure 3:
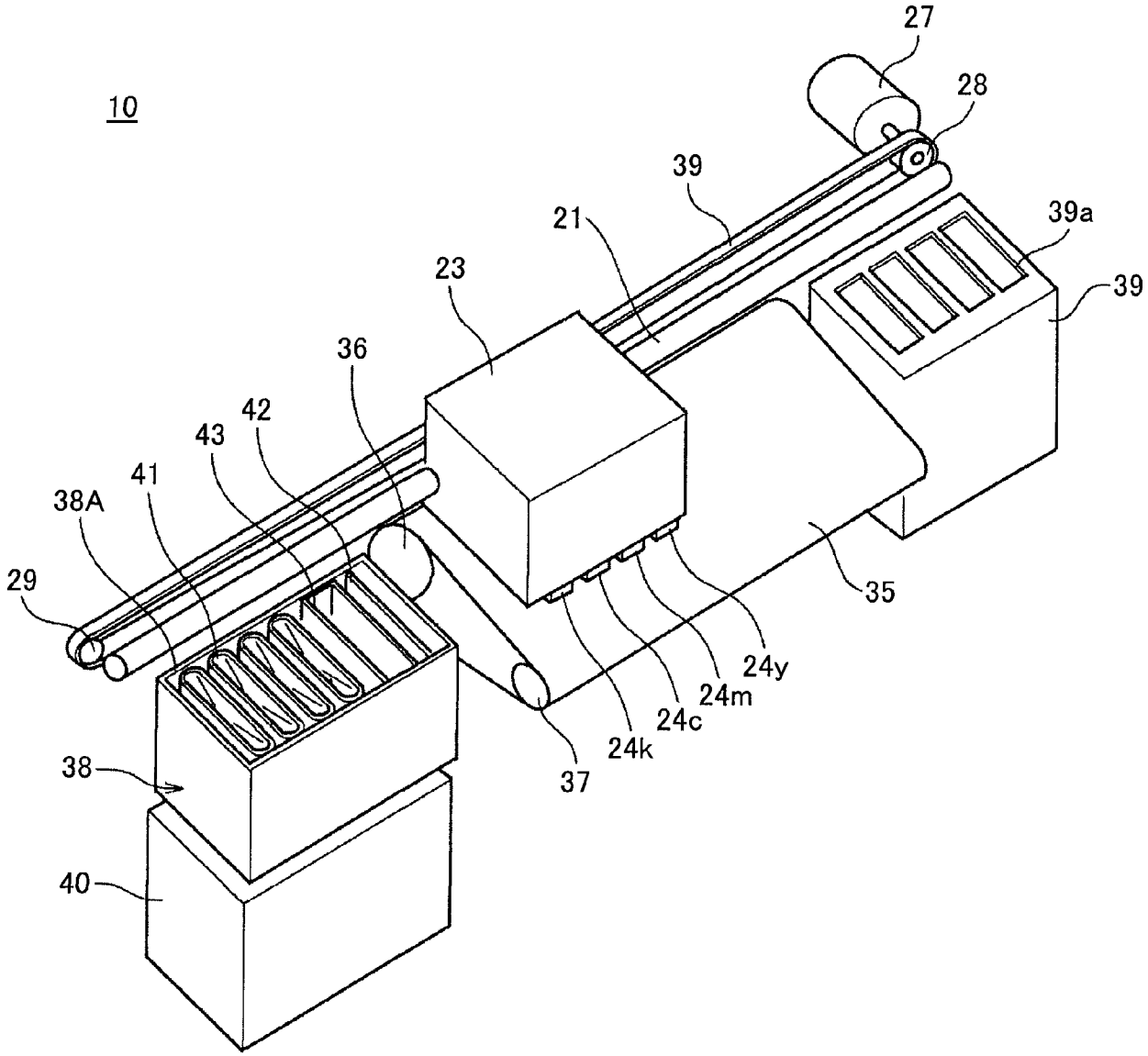
FIG. 3 is a perspective view showing a recording portion including a printing part (image forming part) of an image forming apparatus according to an embodiment of the present invention.
Figure 4:
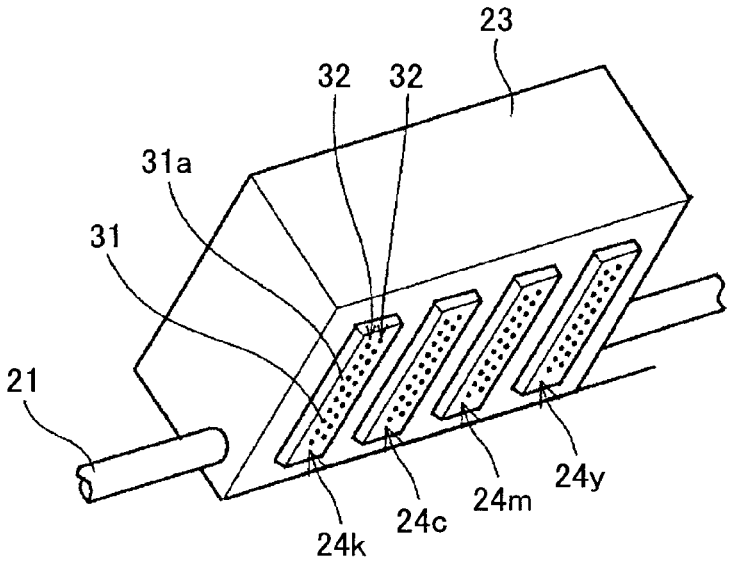
FIG. 4 is a perspective view observed from a bottom side of a carriage of an image forming apparatus according to an embodiment of the present invention.

An image forming apparatus according to an embodiment of the present invention is described with reference to FIGS. 1 through 4. FIG. 1 is a schematic view showing an overall configuration of an image forming apparatus 100 according to an embodiment of the present invention. FIG. 2 is a right side view of the image forming apparatus 100 shown in FIG. 1. FIG. 3 is a perspective view showing a recording portion 3 including a printing part (image forming part) 10 of the image forming apparatus 100 according to an embodiment of the present invention. FIG. 4 is a perspective view observed from a bottom side of a carriage 23 of the image forming apparatus 100 according to an embodiment of the present invention.

The image forming apparatus 100 in this embodiment of the present invention is a copy machine. The image forming apparatus 100 has a main body 1 including an image reading portion 2 (e.g. scanner) for reading an image from a document, the recording portion 3 for forming an image on a recording medium (hereinafter referred to as "paper") P, and a sheet-feed cassette portion 4 for feeding the paper P to the recording portion 3. In the image forming apparatus 100, the papers P stored in the sheet-feed cassette portion 4 are separated and fed sheet-by-sheet by a sheet-feed roller 5 and a separating pad 6. Then, the paper P is conveyed to the printing part 10 via a conveying path 7. In the printing part 10, an image is recorded (formed) on the paper P. Then, the paper P on which the image is formed is conveyed to a sheet-discharge path 8. Then, the paper P is discharged from the sheet-discharge path 8. Then, the discharged paper P is stacked on a sheet-stacking part 9.

As shown in FIG. 3, the printing part 10 includes a carriage 23 supported by a carriage guide (guiding rod) 21 and a guide stay (not shown) for moving in a main scanning direction. The carriage 23 is driven to move in the main scanning direction by a main scan motor 27 via a timing belt 30 spanning between a driving pulley 28 and a driven pulley 29.

Liquid jet heads 24*k*, 24*c*, 24*m*, and 24*y* (also collectively referred to as "recording head 24") for ejecting inks corresponding to black (K), cyan (C), magenta (M), and yellow (Y) are mounted on the carriage 23.

As shown in FIG. 4, each liquid jet head 24 has plural liquid ejecting nozzles 31 arranged in two rows (nozzle rows) 32. The nozzle rows 32 are arranged in a direction orthogonal to the main scanning direction (moving direction of the carriage 23). The plane (nozzle plane) 31*a* of the liquid jet head 24 on which the nozzles 31 are formed faces downward. Furthermore, ink of a corresponding color is supplied to each recording head 24 from an ink cartridge 26.

The recording head 24 may be, for example, a piezoelectric type recording head which uses a piezoelectric element (pressure generating part or actuating part) for ejecting ink droplets by changing the volume in an ink flow channel (stress generating chamber) by changing the shape of a vibration plate that forms the wall of the ink flow channel. Alternatively, the recording head 24 may be a thermal type recording head which uses a heat resistor for ejecting ink droplets by heating ink inside an ink flow channel and generating bubbles which create the pressure for ejecting the ink droplets. Alternatively, the recording head 24 may be an electrostatic type recording head 24 for ejecting ink droplets by arranging a vibration plate and an electrode facing each other and changing the volume in an ink flow channel by changing the shape of the vibration plate by generating an electrostatic force between the vibration plate and the electrode.

Furthermore, an endless conveying belt 35 is provided below the carriage 23 for carrying the paper P thereon by using, for example, an electrostatic attracting force. The conveying belt 35 spans between a driving roller 36 and a driven roller 37. By rotating the conveying belt 35, the paper P is conveyed in a direction perpendicularly intersecting the main scanning direction.

Furthermore, a maintenance/recovery mechanism (maintenance/recovery apparatus) 38 is provided in a non-printing area on one end of the moving direction of the carriage 23 as shown in FIGS. 2 and 3. The recovery mechanism is for maintaining and recovering the condition of the nozzles 31 of the recording head 24. The recovery mechanism 38 includes a blank ejection receiver 39 for receiving droplets (droplets not used for recording) in a non-printing area on the other end of the moving direction of the carriage 23.

The maintenance/recovery mechanism 38 includes plural cap members 41 (in this example, an absorbing cap 41*a* and three moisture retention caps 42*b*) for capping (covering) each nozzle plane 31*a* of the recording head 24, a wiper blade (wiping member) 42 for wiping the nozzle plane 31*a* of the recording head 24, and a blank ejection receiver (first discharging part) 43. The absorbing cap 41*a* is connected to an absorbing pump (suction pump) 45 that uses a pumping tube. Thereby, waste ink can be discharged from the absorbing pump 45 to a waste ink container 40 situated below the absorbing pump 45 via a discharge tube (second discharging part) 46. Furthermore, a bottom part of the blank ejection receiver 43 is positioned facing the waste liquid container 40 for allowing unwanted waste liquid (ejected by blank-ejection) to be discharged (dropped) into the waste liquid container 40. Furthermore, four openings 39*a* are formed in the blank ejection receiver 39.

Figure 5:
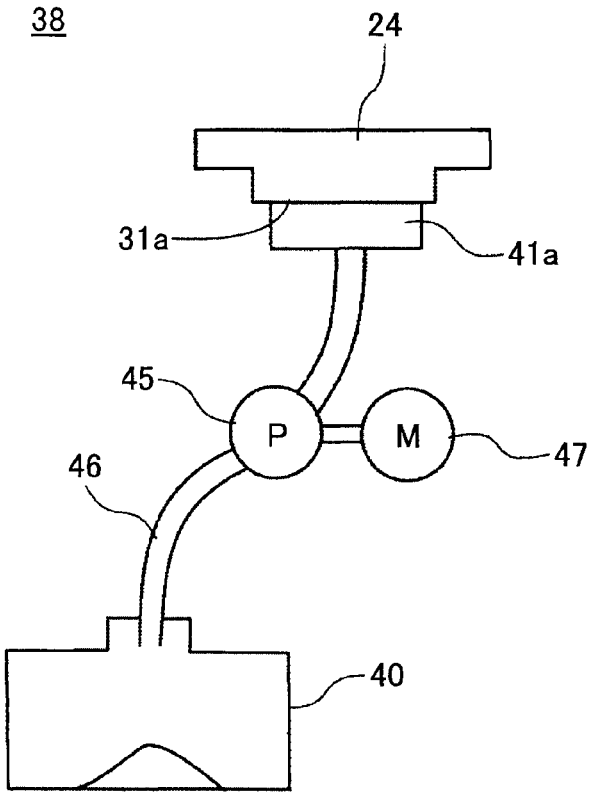
FIG. 5 is a schematic diagram for describing a head absorption (head suction) operation according to an embodiment of the present invention.

Next, a part in the maintenance/recovery mechanism 38 for performing a head absorption (head suction) operation (an operation of forcing ink to be discharged from the nozzles 31) is described with reference to FIG. 5.

At a certain timing or when the viscosity of the ink inside the nozzles 31 of the recording head 24 increases to a level preventing ink droplets from being normally ejected, the nozzle plane 31*a* of the recording head 24 is sealed with the absorbing cap 41*a* and the absorbing pump 41*a* is rotated with an absorbing pump motor 47, to thereby create a vacuum (negative pressure) state in a space formed inside the recording head 24 by the nozzle plane 31*a* and the absorbing cap 41*a*. The negative pressure allows the ink inside the nozzles 31 to be suctioned and discharged from the nozzles 31. The discharged waste liquid is pumped by the absorbing pump 45 and discharged to the waste liquid container 40.

Next, the waste liquid container 40 according to a first embodiment of the present invention is described in detail with reference to FIGS. 6 through 8.

Figure 6:
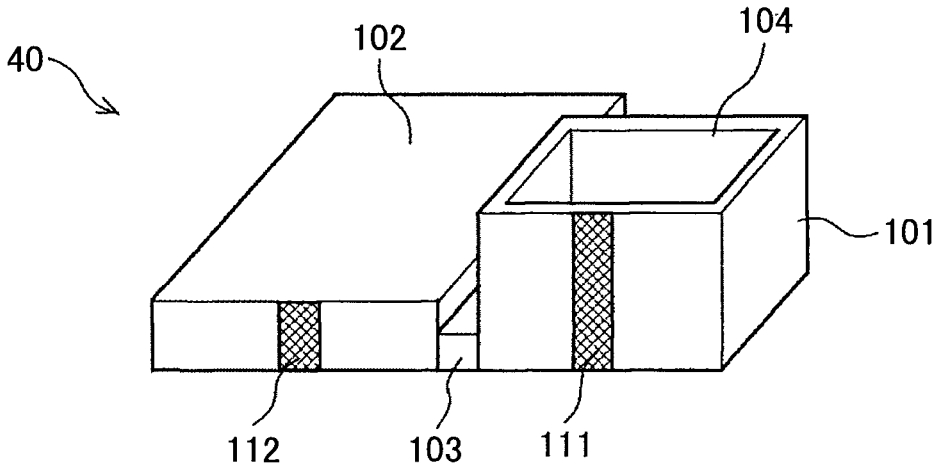
FIG. 6 is a schematic diagram showing a first example of a waste liquid container according to a first embodiment of the present invention.

As shown in FIG. 6, a first example of the waste liquid container 40 according to the first embodiment of the present invention includes a first container 101 having a single waste liquid inlet 104 into which the waste liquid is introduced and a second container 102 communicating with the first container 101. The first and second containers 101, 102 are detachably connected to each other by a communication path 103.

The viscosity (liquidity) of the waste liquid introduced from the waste liquid inlet 104 differs depending on various conditions (e.g., type of output image, number of output pages, frequency of usage) or the environment where the image forming apparatus is installed. The waste liquid having high viscosity remains in the first container 101. By providing an inclination (not shown) at the bottom of the first container 101, the waste liquid having low viscosity is guided from the first container 101 to the second container 102 via the communication path 103. Thus, the waste liquid having low viscosity is stored in the second container 102.

Figure 7:
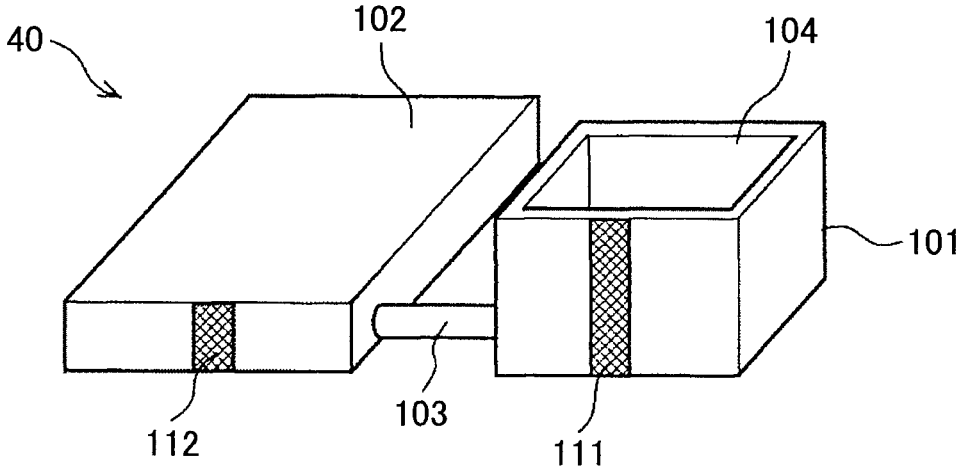
FIG. 7 is a schematic diagram showing a second example of a waste liquid container according to the first embodiment of the present invention.

As shown in FIG. 7, a second example of the waste liquid container 40 according to the first embodiment of the present invention has the communication path 103 shaped as a tube. For example, by forming the communication path 103 with a tube made of rubber material (e.g., silicone), the first and second containers 101, 102 can be positioned apart from each other.

Figure 8:
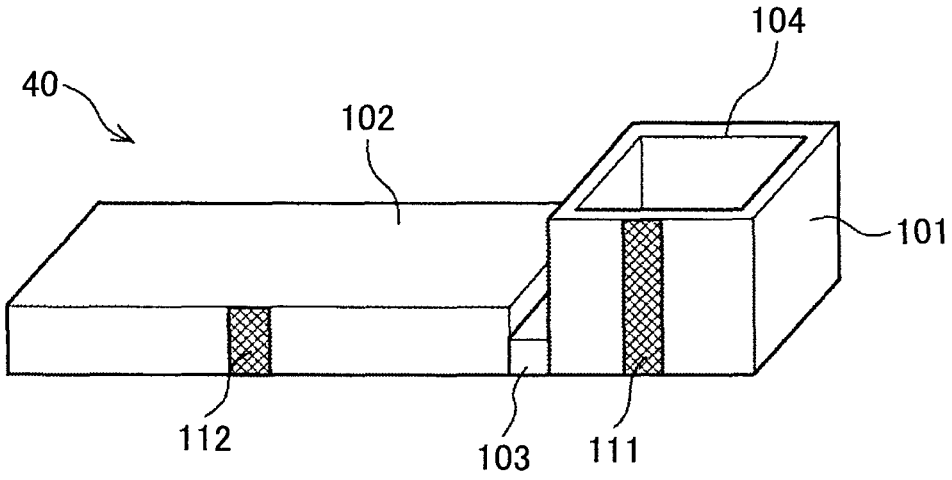
FIG. 8 is a schematic diagram showing a third example of a waste liquid container according to the first embodiment of the present invention.

As shown in FIG. 8, a third example of the waste liquid container 40 has the second container 102 formed with a long length in view of the high liquidity of the waste liquid having low viscosity. The second container 102 may be formed in other shapes matching the space inside the image forming apparatus 100. For example, the second container 102 may be formed in a bag-like shape.

Next, the waste liquid container 40 according to a second embodiment of the present invention is described in detail with reference to FIGS. 9 through 11.

Figure 9:
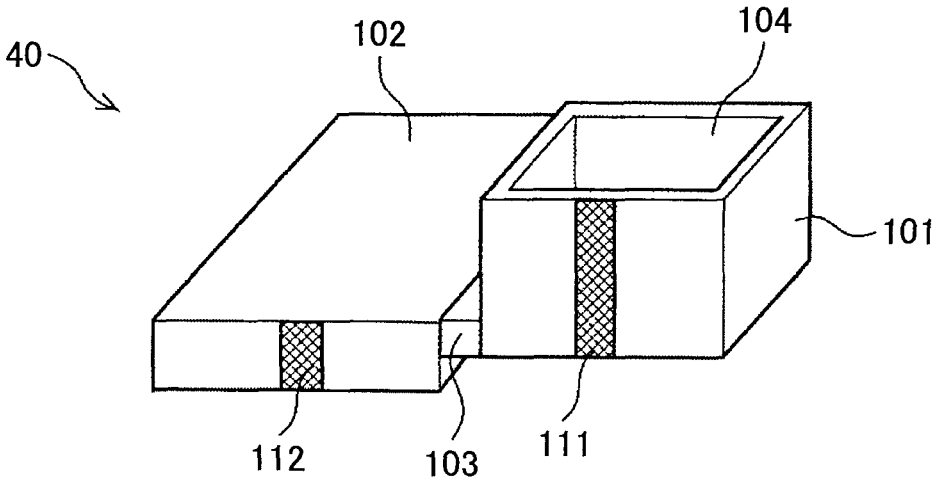
FIG. 9 is a schematic diagram showing a first example of a waste liquid container according to a second embodiment of the present invention.
Figure 10:
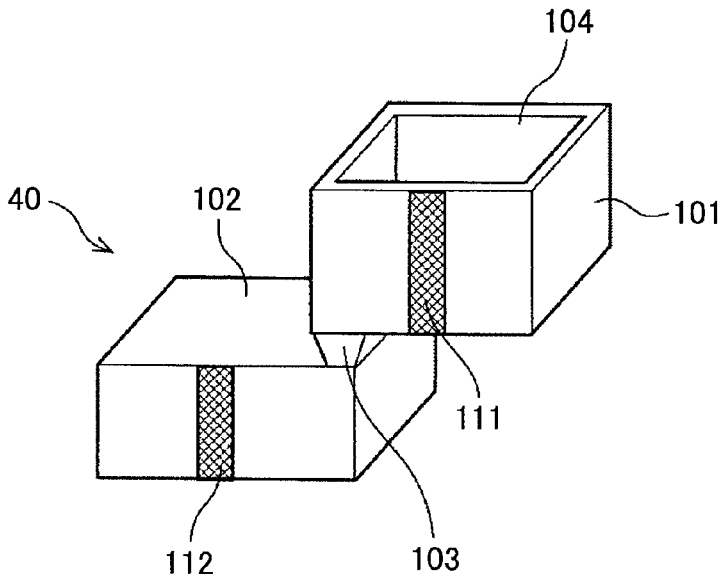
FIG. 10 is a schematic diagram showing a second example of a waste liquid container according to the second embodiment of the present invention.
Figure 11:
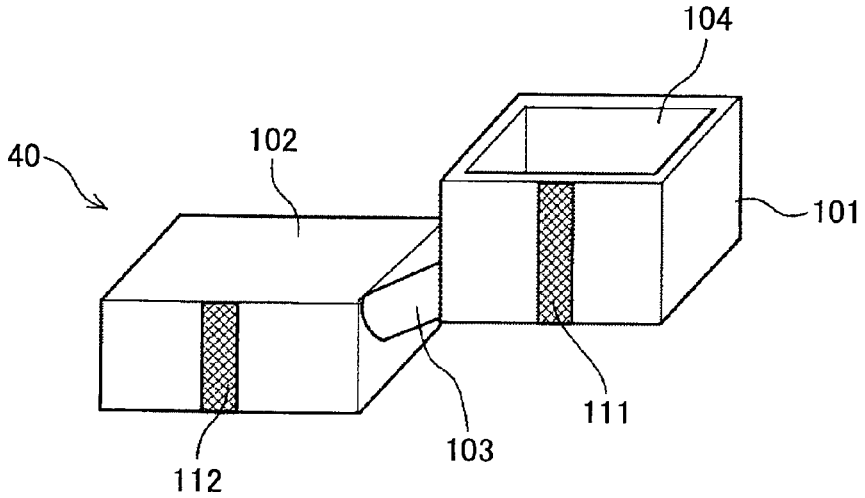
FIG. 11 is a schematic diagram showing a third example of a waste liquid container according to the second embodiment of the present invention.

As shown in FIGS. 9 through 11, the following first through third examples of the waste liquid container 40 according to the second embodiment of the present invention have the second container 102 provided at a position lower than the first container 101. The first and second containers 101, 102 are detachably connected to each other by a communication path 103. By positioning the second container 102 lower than the first container 101, the waste liquid having low viscosity can quickly flow from the first container 101 into the second container 102.

As shown in FIG. 9, a first example of the waste liquid container 40 according to the second embodiment of the present invention has a side bottom part of the first container 101 connected to a side upper part of the second container 102 via the communication path 103.

As shown in FIG. 10, a second example of the waste liquid container 40 according to the second embodiment of the present invention has a bottom part of the first container 101 connected to a top part of the second container 102 via the communication path 103 by superposing a portion of the first container 101 on a portion of the second containers 102 via the communication path 103.

As shown in FIG. 11, a third example of the waste liquid container 40 according to the second embodiment of the present invention has the communication path 103 shaped as a tube for connecting the first and second containers 101, 102 that are positioned apart from each other.

Next, the waste liquid container 40 according to a third embodiment of the present invention is described in detail with reference to FIGS. 12 and 13.

Figure 12:
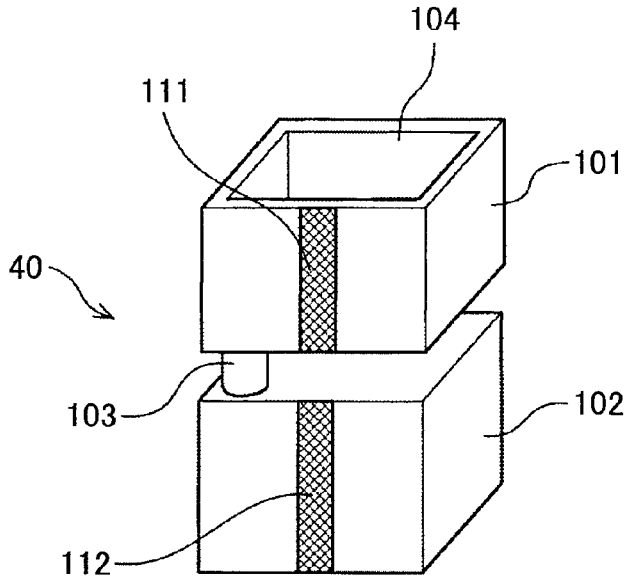
FIG. 12 is a schematic diagram showing a second example of a waste liquid container according to a third embodiment of the present invention.
Figure 13:
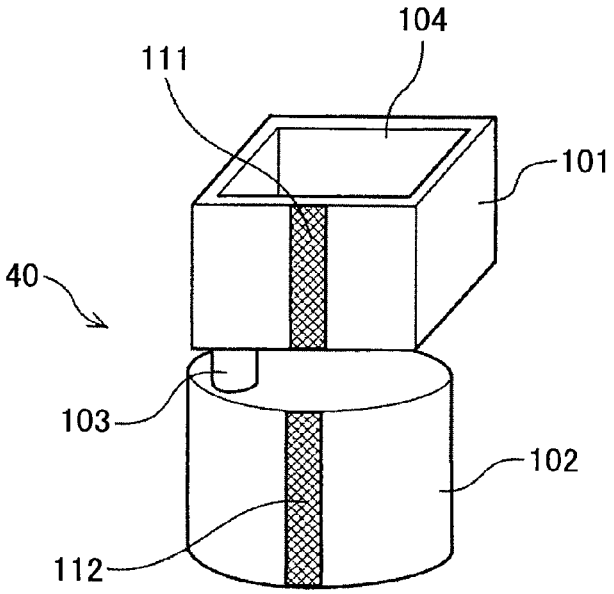
FIG. 13 is a schematic diagram showing a second example of a waste liquid container according to the third embodiment of the present invention.

As shown in FIGS. 12 and 13, the following first and second examples of the waste liquid container 40 according to the third embodiment of the present invention have the second container 102 provided immediately below the first container 101 and have the first and second containers 101, 102 detachably connected to each other by the communication path 103. With this configuration of the first and second examples of the waste liquid container 40 according to the third embodiment of the present invention, waste liquid having high viscosity (accumulating waste liquid) remains in the first container 101 and waste liquid having low viscosity is contained in the second container 102. In both examples of the waste liquid container 40 according to the third embodiment of the present invention, the communication path 103 is located at a position deviating from the area where the waste liquid dropping from the waste liquid inlet 104 lands (landing area).

Figure 14:
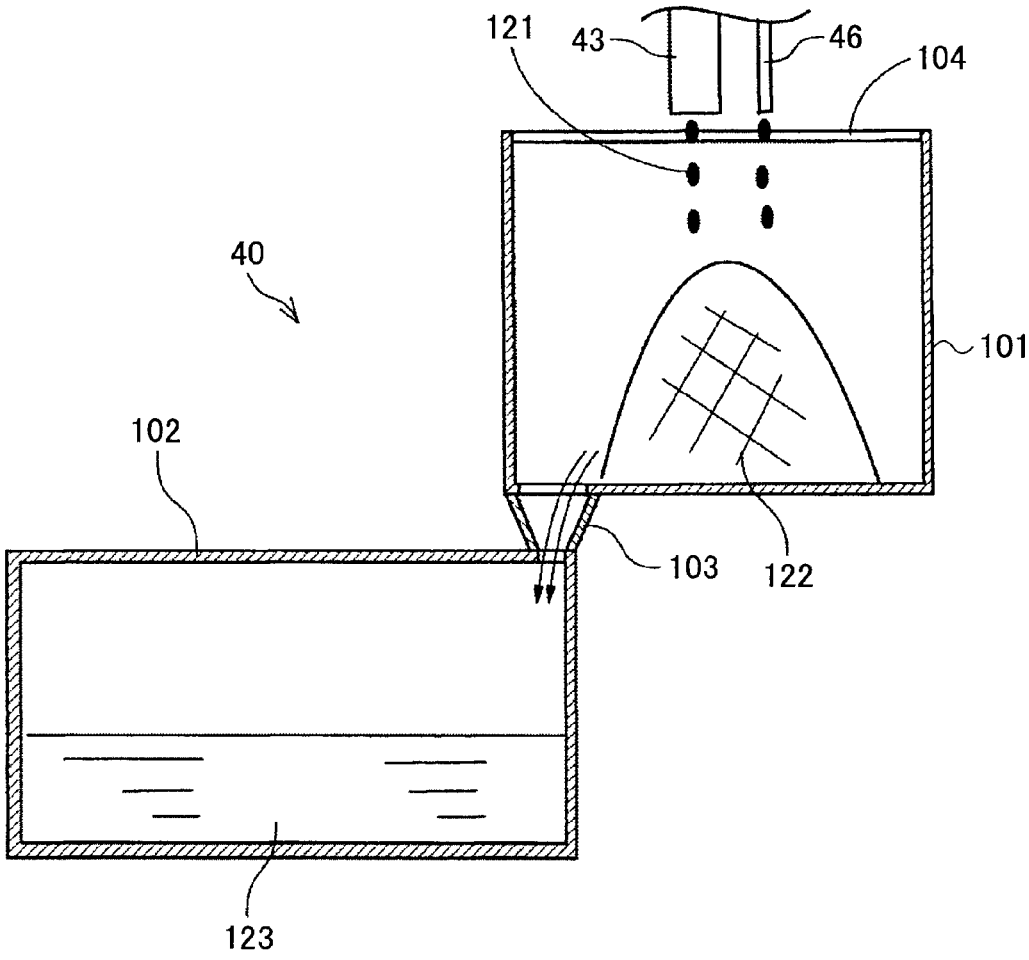
FIG. 14 is a schematic diagram for describing storing of waste liquid by a waste liquid container according to an embodiment of the present invention.

Next, the waste liquid container 40 according to the above-described embodiments of the present invention is described in further detail with reference to FIG. 14. In a case where waste ink (waste liquid not contributing to image formation) 121 discharged from the blank ejection receiver 43 or the discharge tube 46 is introduced into the waste liquid inlet 104, solid waste matter 122 contained in the waste ink 121 accumulates inside the first container 101 and liquid waste matter 123 contained in the waste ink 121 flows into the second container 102 via the communication path 103.

In the waste liquid container 40 according to the above-described embodiments of the present invention, a first sensor (first detecting part) 111 including a capacitance type sensor (electric field sensor or sensor electrode) is provided on the sidewalls of the first container 101 and a second sensor (second detecting part) 112 also including a capacitance type sensor (electric field sensor or sensor electrode) is provided on the side walls of the second container 102. The first and second sensors 111, 112 have sensor electrodes provided on the entire side walls of the first and second containers 101, 102 with respect to the height direction of the first and second containers 101, 102.

Figure 15:
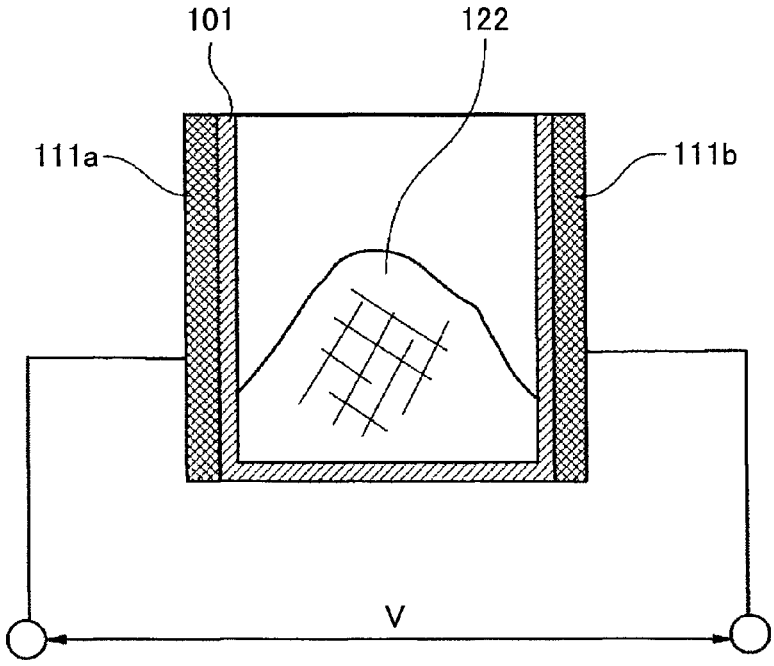
FIG. 15 is a schematic diagram for describing a principle of a detecting operation performed by a capacitance type sensor of a first sensor according to an embodiment of the present invention.

FIG. 15 is a schematic diagram for describing a principle of a detecting operation performed by the capacitance type sensor of the first sensor 111 according to an embodiment of the present invention. A pair of sensor electrodes 111*a*, 111*b* is provided in parallel at the oppositely facing outer sidewalls of the first container 101. As described above, the solid waste matter 122 contained in the waste ink 121 accumulates inside the first container 101. With this accumulation, the capacitance between the sensor electrodes 111*a* and 111*b* is measured by applying an alternating current electric field V to the sensor electrodes 111*a*, 111*b*. The capacitance between the two sensor electrodes 111*a*, 111*b* is a value obtained by a formula expressed as "capacitance (F)=(dielectric constant of material×area of electrode/distance between electrodes)". Since the values for "area of electrode" and "distance between electrodes" are defined (fixed), the capacitance changes depending on the value of the "dielectric constant of material" (i.e. the dielectric constant of the material located between the sensor electrode 111*a* and the sensor electrode 111*b*). Accordingly, since the measured value of the capacitance directly corresponds to the amount of the solid waste matter 122 accumulated in the first container 101, the height of the solid waste matter 122 accumulated in the first container 101 can be detected by referring to the measured value.

Likewise, a pair of sensor electrodes (not shown) may be provided to oppositely facing outer sidewalls of the second container 102, and the capacitance between the pair of sensor electrodes can be measured. Accordingly, since the measured value of the capacitance directly corresponds to the amount of the liquid waste matter 123 (not solidified) in the second container 102, the height of the liquid waste matter 123 contained in the second container 102 can be detected by referring to the measured value.

Alternatively, instead of providing the pair of sensor electrodes of the first container or the pair of sensor electrodes of the second container to oppositely facing sidewalls, the pairs of sensor electrodes may be provided on the same sidewall. Even in a case where the pairs of sensor electrodes are provided to the same sidewall, an electric field, which covers the space inside the first container 101 or the second container 102, can be generated. Accordingly, the status of the waste matter 122, 123 in the inside space of the first and second containers 101, 102 can be detected.

Accordingly, when the first sensor 111 detects that the solid waste matter 122 in the first container 101 has reached a predetermined height, the first container 101 is determined to be full. Likewise, when the second sensor 112 detects that the fluid waste matter 112 in the second container 102 has reached a predetermined height, the second container is determined to be full. Upon detecting that either one of the first and second sensors 111, 112 is detected to be full, the waste liquid container 40 may be determined to be full.

Since the waste liquid container 40 is configured having a first container provided with a single waste liquid inlet and a second container detachably connected in communication with respect to the first container, only the container detected to be full needs to be replaced. Thereby, the space of the waste liquid container 40 can be efficiently used.

Furthermore, by providing the first and second detecting parts in the first and second containers, full containers can be detected separately. Thereby, each container can be replaced at a suitable timing.

Next, the waste liquid container 40 according to a fourth embodiment of the present invention is described in detail with reference to FIGS. 16 through 18.

Figure 16:
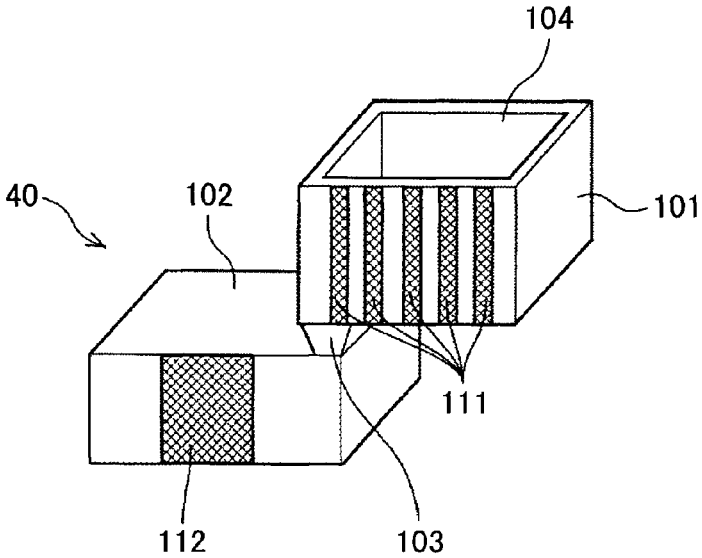
FIG. 16 is a schematic diagram showing a first example of a waste liquid container according to a fourth embodiment of the present invention.

As shown in FIG. 16, in a first example of the waste liquid container 40 according to the fourth embodiment of the present invention, plural first sensors 111 are provided on the entire sidewall of the first container 101 while a wide second sensor 112 is provided on the sidewall of the second container 102. With this configuration, the shape and the position of the peak of the solid waste matter 122 in the first container 101 can be detected.

Figure 17:
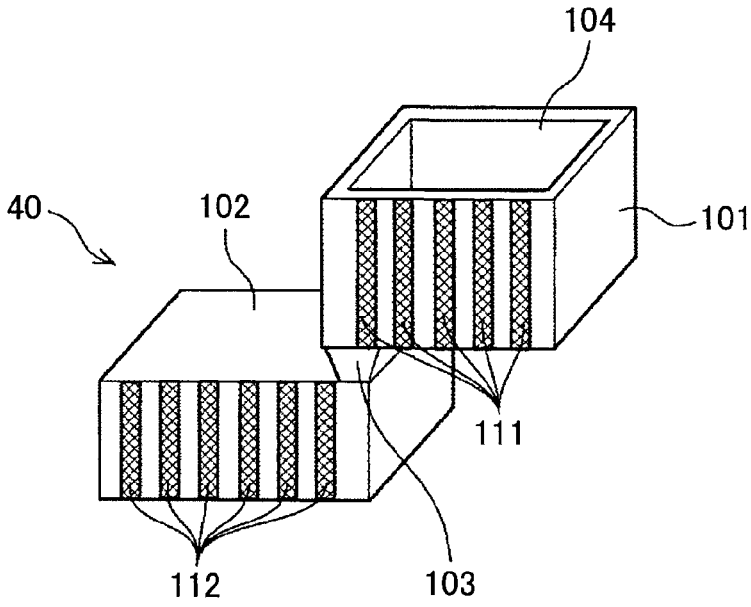
FIG. 17 is a schematic diagram showing a second example of a waste liquid container according to the fourth embodiment of the present invention.

As shown in FIG. 17, in a second example of the waste liquid container 40 according to the fourth embodiment of the present invention, plural first sensors 111 are provided on the entire sidewall of the first container 101 while plural second sensors 112 are also provided on the entire sidewall of the second container 102. With this configuration, the shape of the waste matter of the entire waste liquid container 40 can be detected.

Figure 18:
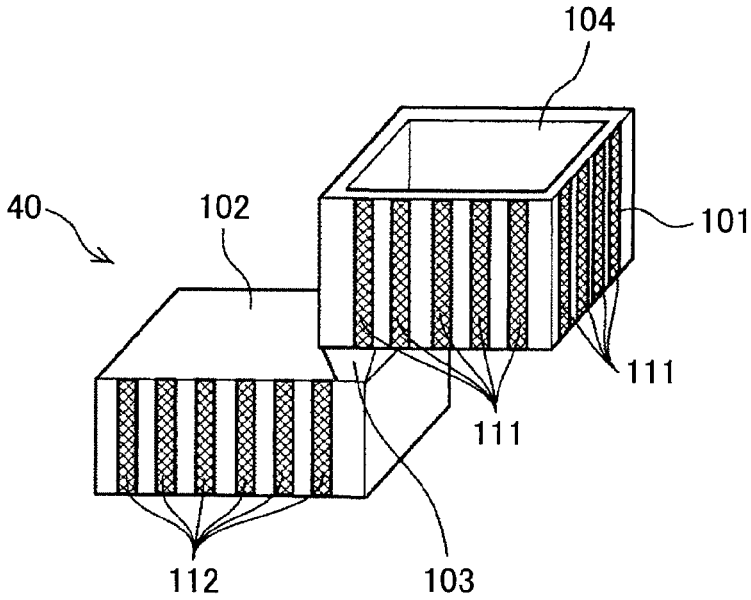
FIG. 18 is a schematic diagram showing a third example of a waste liquid container according to the fourth embodiment of the present invention.

As shown in FIG. 18, in a third example of the waste liquid container 40 according to the fourth embodiment of the present invention, plural first sensors 111 are provided on the entire four sidewalls of the first container 101 while plural second sensors 112 are provided on an the entire single sidewall of the second container 102. With this configuration, the three-dimensional shape and the peak of the solid waste matter 122 accumulated in the first container 101 can be detected.

Figure 19:
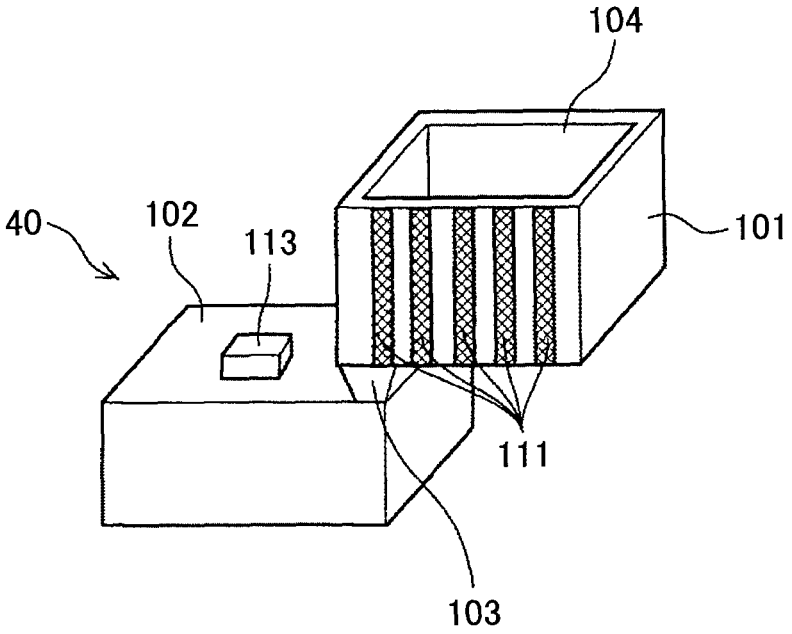
FIG. 19 is a schematic diagram for describing a waste liquid container according to a fifth embodiment of the present invention.

Next, the waste liquid container 40 according to a fifth embodiment of the present invention is described in detail with reference to FIG. 19. The waste liquid container 40 according to the fifth embodiment of the present invention includes the capacitance type first sensor 111 and an optical sensor 113 acting as the second detecting part attached to a top wall of the second container 102.

Figure 20:
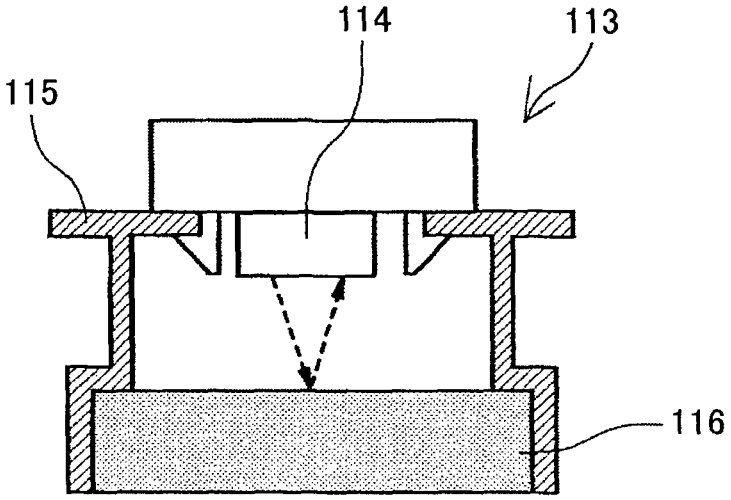
FIG. 20 is a schematic view for describing a second detecting part according to the fifth embodiment of the present invention.
Figure 21:
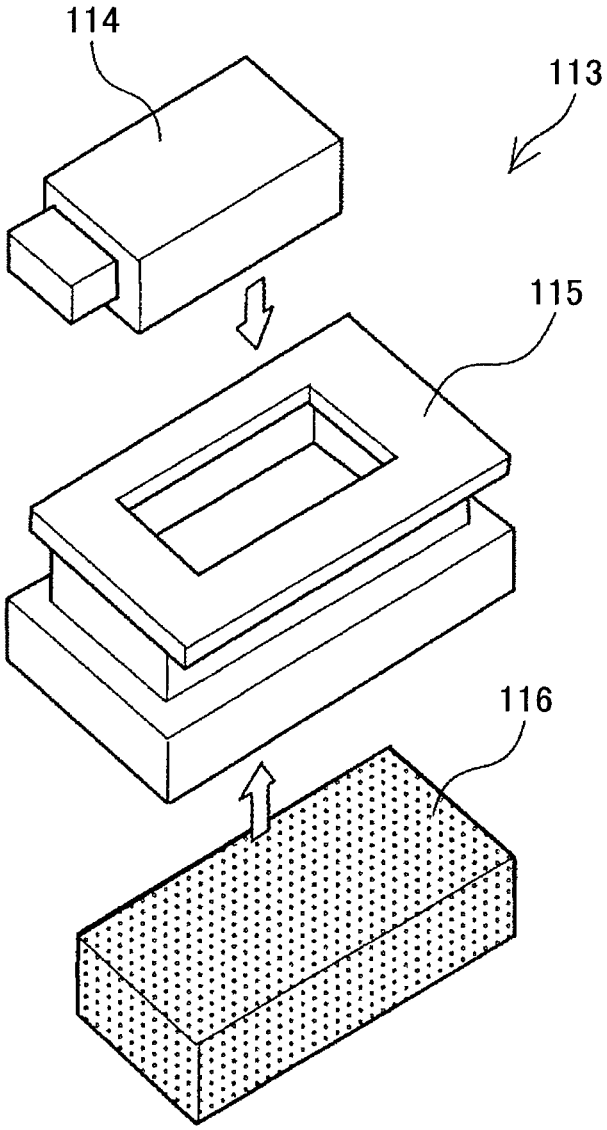
FIG. 21 is a disassembled schematic view for describing a second detecting part according to the fifth embodiment of the present invention.

FIGS. 20 and 21 are schematic diagrams for describing the optical sensor 113. The optical sensor 113 according to an embodiment of the present invention includes a reflection type photosensor 114, an absorbing member 116 for absorbing waste ink, and a case 115 for holding the photosensor 114 and the absorbing member 116. The absorbing member 116 is a material having a characteristic of easily absorbing liquid waste ink (e.g., felt, sponge) and having a color capable of sufficiently reflecting light (e.g., white). The photosensor 114 is attached to the case 115 so that a certain distance is kept from the absorbing member 116. The case 115 provides a sealed space between the absorbing member 116 and the photosensor 114 so that light or ink mist can be prevented from entering the space. By sealing the space between the absorbing member 116 and the photosensor 114, ink mist can be prevented from adhering to a sensor surface of the photosensor 114. Thereby, erroneous detection by the photosensor 114 can be prevented. Furthermore, by sealing the space, only the light reflected from the absorbing member 116 is detected by the photosensor 114. Thereby, the photosensor 114 can satisfactorily determine whether waste ink is absorbed by the absorbing member 116.

As shown in FIGS. 20 and 21, the photosensor 114 has claw parts which pressingly engage the upper opening part of the case 115 when the photosensor 114 is inserted in the upper opening part of the case 115. Thereby, the photosensor 114 can be attached to the case 115. The absorbing member 116 is fixed to an absorbing member holding part of the case 115 by using, for example, an adhesive agent. The absorbing member 116 is attached to the top wall of the second container 102 in a manner that the absorbing member 116 faces the inside of the second container 102 and absorbs the waste ink inside the second container 102.

Thereby, the liquid waste matter 123 is absorbed by the absorbing member 116 as its height inside the second container 102 increases, and the color of the absorbing member 116 changes as the liquid waste matter 123 is absorbed. Accordingly, the optical sensor 114 can detect whether the second container 102 is full.

Figure 22:
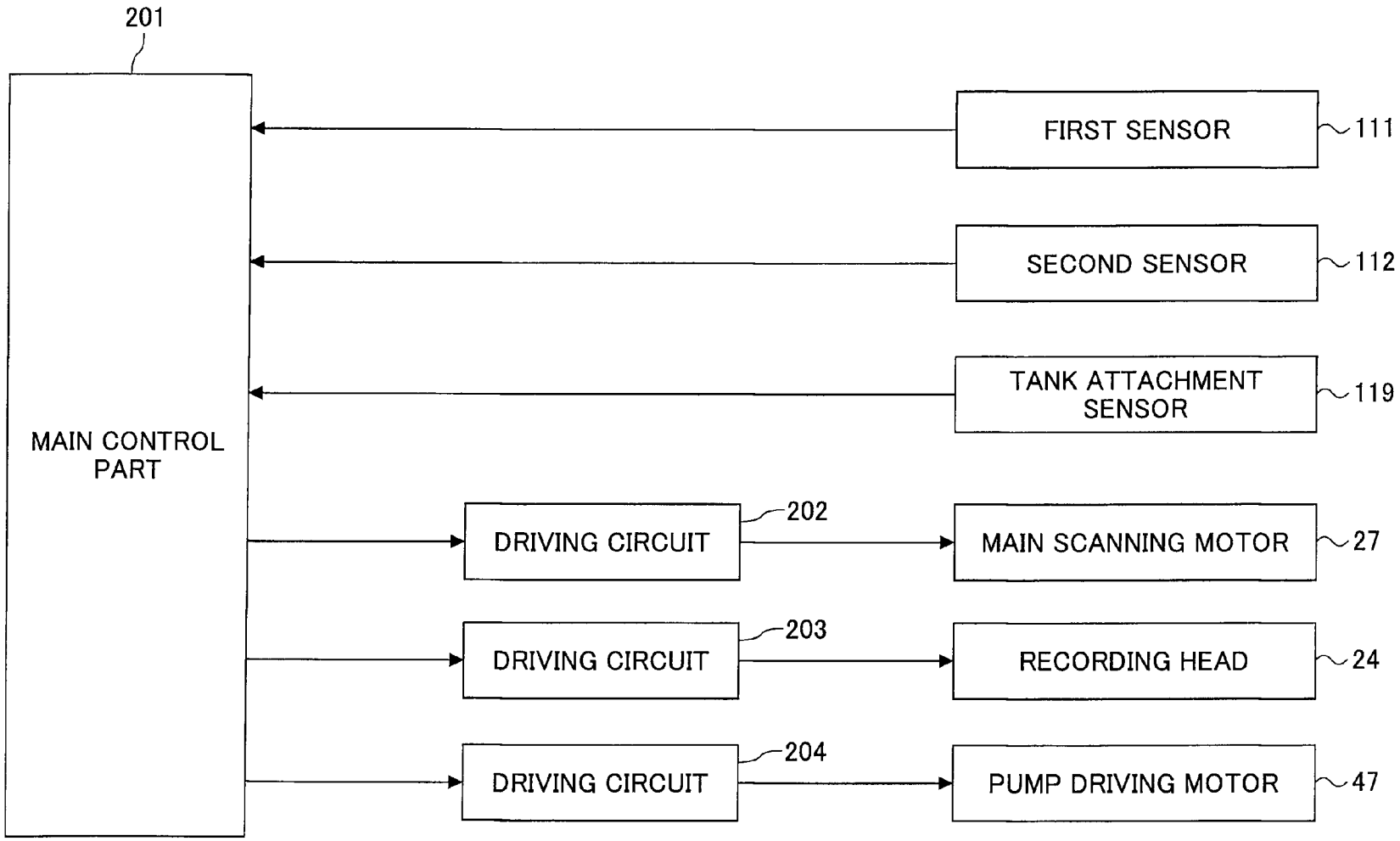
FIG. 22 a block diagram showing a portion related to controls performed by a main control part for detecting a full waste liquid container and changing a waste ink discharging position according to an embodiment of the present invention.

Next, an example of a main control part 201 of the image forming apparatus 100 including the above-described waste liquid container 40 is described with reference to FIG. 22. FIG. 22 is a block diagram of a portion related to controls performed by the main control part 201 for detecting a full waste liquid container 40 and changing a waste ink discharging position.

The main control part 201 is for performing control of the entire image forming apparatus 100 including control for changing a waste liquid discharging position according to an embodiment of the present invention. The main control part 201 includes, for example, a CPU, a ROM, a RAM, an I/O device, and a rewritable non-volatile memory. The main control part 201 moves the carriage 23 in a desired direction for a prescribed amount by rotating the main scan motor 27 via a driving circuit 202. Furthermore, the main control part 201 drives the recording head 24 for ejecting liquid droplets (e.g., ink) via a driving circuit 203. Furthermore, the main control part 201 drives the absorbing pump 45 by rotating the absorbing pump motor 47 via a driving circuit 204.

The main control part 201 also determines whether the first and second containers 101, 102 of the waste liquid container 40 are in a full state or a nearly-full (almost full container) by receiving detection signals indicative of other status of the waste liquid inside the waste liquid container 40 from the first and second sensors 111, 112 and comparing the detection results with a predetermined threshold(s). The main control part 201 also determines whether the waste liquid container 40 is mounted by receiving detection signals from a tank mount sensor 119.

Figure 23:
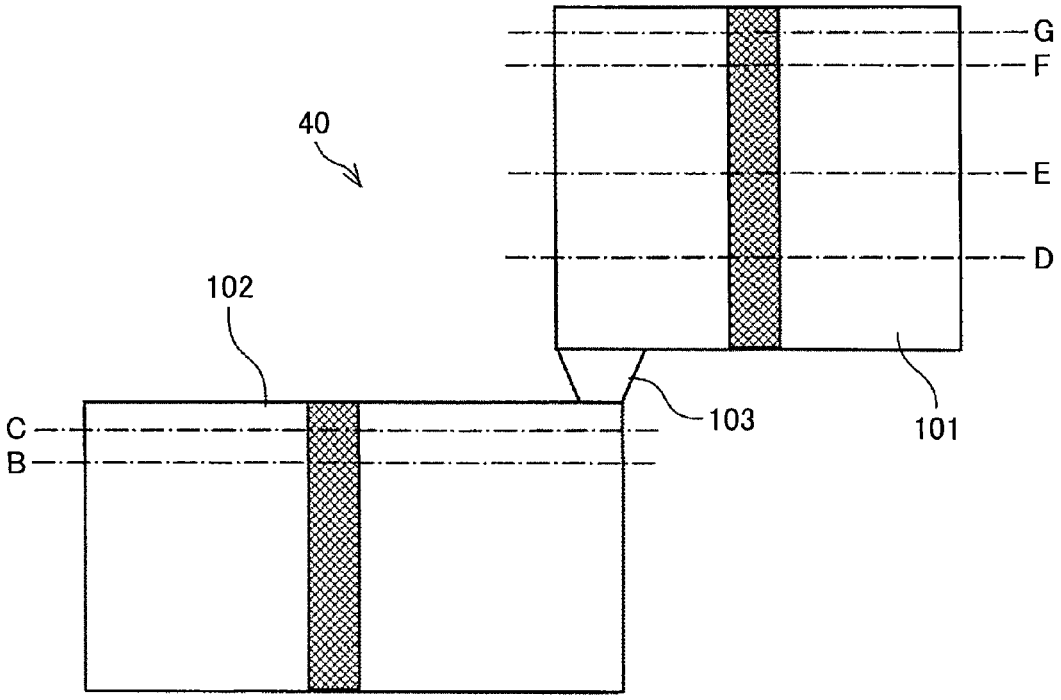
FIG. 23 is a schematic diagram for describing thresholds set for a waste liquid container according to an embodiment of the present invention.

Next, thresholds that are set in correspondence with the first sensor 111 of the first container 101 and the second sensor 112 of the second container 102 are described with reference to FIG. 23.

One or more thresholds are set with respect to the shape (capacity) of the first container 101 of the waste liquid container 40 beforehand. In a case where the waste liquid reaches any one of the thresholds, the main control part 201 may control (limit) usage of the image forming apparatus 100 or change a position for discharging waste ink. For example, in order to detect the status of the first container 101, thresholds D, E, F, G are set in correspondence with the height (position)

of the solid waste matter 122 detected by the first sensor 111 (corresponding heights satisfying a relationship of D<E<F<G). Furthermore, in order to detect the status of the second container 102, thresholds B and C are set in correspondence with the height (position) of the liquid waste matter 123 detected by the second sensor 112 (corresponding heights satisfying a relationship of B<C). The settings of the thresholds are not limited to those of the above-described example.

Figure 24:
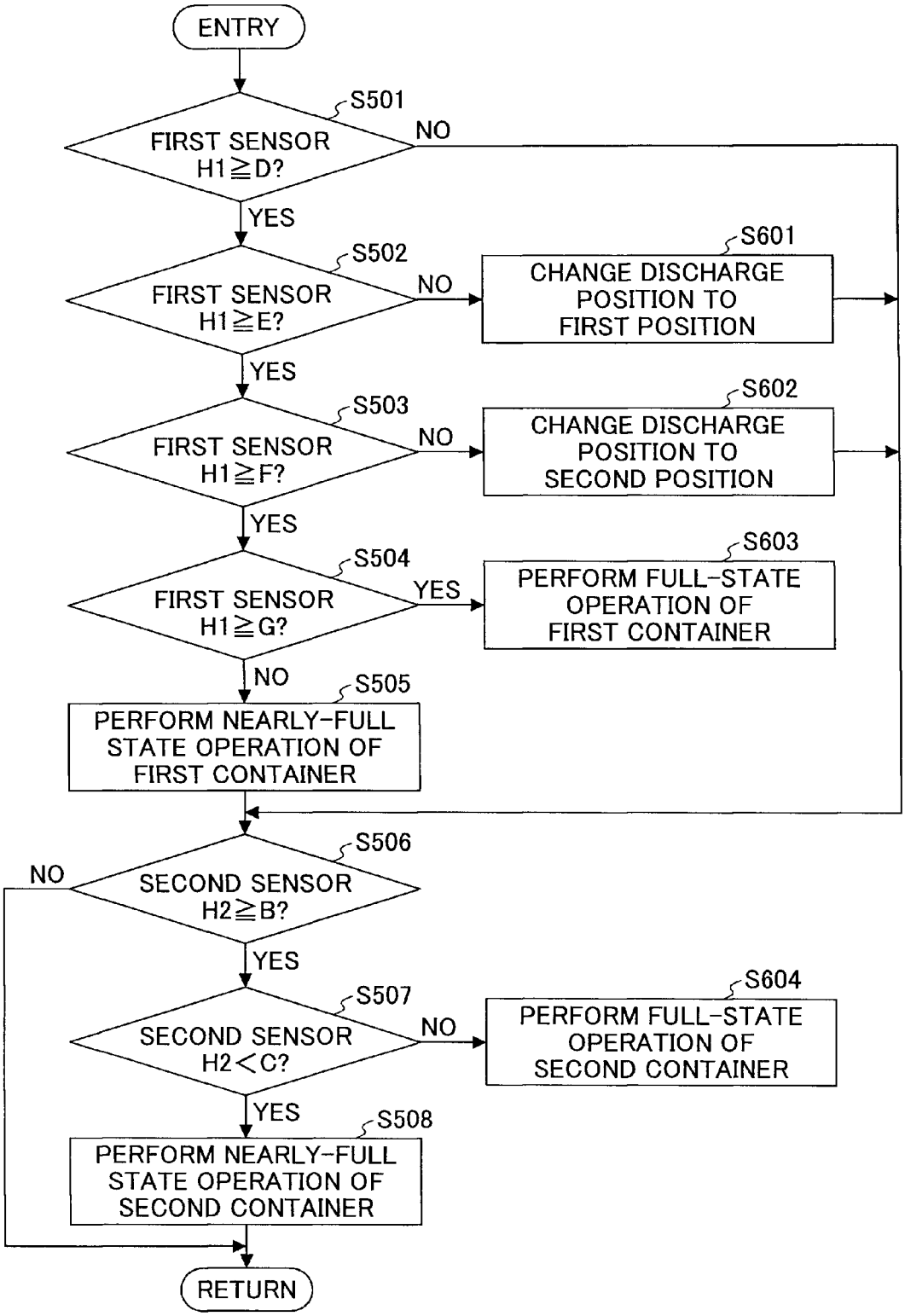
FIG. 24 is a flowchart for describing a waste liquid discharge position changing operation according to an embodiment of the present invention.

Next, a full-container detecting operation and a waste liquid discharge position changing operation according to an embodiment of the present invention are described with reference to FIG. 24.

First, it is determined whether the height of the solid waste matter 122 of the first container 101 detected by the first sensor 111 is equal to or greater than the threshold D (H1≥D) (S501). In a case where the height of the solid waste matter 122 has not reached the threshold D (No in S501), it is determined whether the height of the liquid waste matter 123 of the second container 102 detected by the second sensor 112 is equal to or greater than the threshold B (H2≥B) (S506). If the height of the liquid waste matter 123 is less than the threshold B, the operation returns to the beginning.

On the other hand, in a case where the height of the solid waste matter 122 is equal to or greater than the threshold D (Yes in S501), it is determined whether the height of the solid waste matter 122 of the first container 101 detected by the first sensor 111 is equal to or greater than the threshold E (H1≥E) (S502) In a case where the height H1 is less than the threshold E, that is, in a case where the height H1 is equal to or greater than the threshold D but less than the threshold E (D≤H1<E), the position for discharging waste ink into the first container 101 is changed to a predetermined first discharge position (variable position α) (S601).

In a case where the height H1 is equal to or greater than the threshold E, it is determined whether the height of the solid waste matter 122 of the first container 101 detected by the first sensor 111 is equal to or greater than the threshold F (H1≥F) (S503). In a case where the height H1 is less than the threshold F, that is, in a case where the height H1 is equal to or greater than the threshold E but less than the threshold F (E≤H1<F), the position for discharging waste ink into the first container 101 is changed to a predetermined second discharge position (variable position β) (S602).

In a case where the height H1 is equal to or greater than the threshold F, it is determined whether the height of the solid waste matter 122 of the first container 101 detected by the first sensor 111 is less than the threshold G (H1<G) (S504). In a case where the height H1 is less than the threshold G, that is, in a case where the height H1 is equal to or greater than the threshold F but less than the threshold G (F≤H1<G), it is determined that the first container 101 is nearly full (nearly-full container). When the first container 101 is determined to be nearly full, a nearly-full container operation is performed. The nearly-full container operation includes, for example, a process for indicating that the first container 101 of the waste liquid container 40 is nearly full on a display of a control panel of the image forming apparatus 100 or reporting that the first container 101 of the waste liquid container 40 is nearly full to a printer driver of a host computer.

On the other hand, in a case where the height H1 is not less than the threshold G, that is, in a case where the height H1 is equal to or greater than the threshold G, it is determined that the first container 101 is full (full container). When the first container 101 is full, a full-container operation is performed. The full-container operation includes, for example, a process of shutting down (stopping) operations of the image forming apparatus 100 along with a process for indicating that the first container 101 of the waste liquid container 40 should be replaced on a display of a control panel of the image forming apparatus 100 or reporting that the first container 101 of the waste liquid container 40 should be replaced to a printer driver of a host computer.

Meanwhile, in a case where the height H2 of the liquid waste matter 123 detected by the second sensor 112 is equal to or greater than the threshold B (H2≥B) (Yes in S506), it is determined whether the height H2 is less than the threshold C (S507). In a case where the height H2 is less than the threshold C, that is, in a case where the height H2 is equal to or greater than the threshold B but less than the threshold C (B≤H2<C), it is determined that the second container 102 is nearly full (nearly-full container). When the second container 102 is determined to be nearly full, a nearly-full container operation is performed. The nearly-full container operation includes, for example, a process for indicating that the second container 102 of the waste liquid container 40 is nearly full on a display of a control panel of the image forming apparatus 100 or reporting that the second container 102 of the waste liquid container 40 is nearly full to a printer driver of a host computer. On the other hand, in a case where the height H2 is not less than the threshold C, that is, in a case where the height H2 is equal to or greater than the threshold C, it is determined that the second container 102 is full (full container). When the second container 102 is full, a full-container operation is performed. The full-container operation includes, for example, a process of shutting down (stopping) operations of the image forming apparatus 100 along with a process for indicating that the second container 102 of the waste liquid container 40 should be replaced on a display of a control panel of the image forming apparatus 100 or reporting that the second container 102 of the waste liquid container 40 should be replaced to a printer driver of a host computer.

Figure 25:
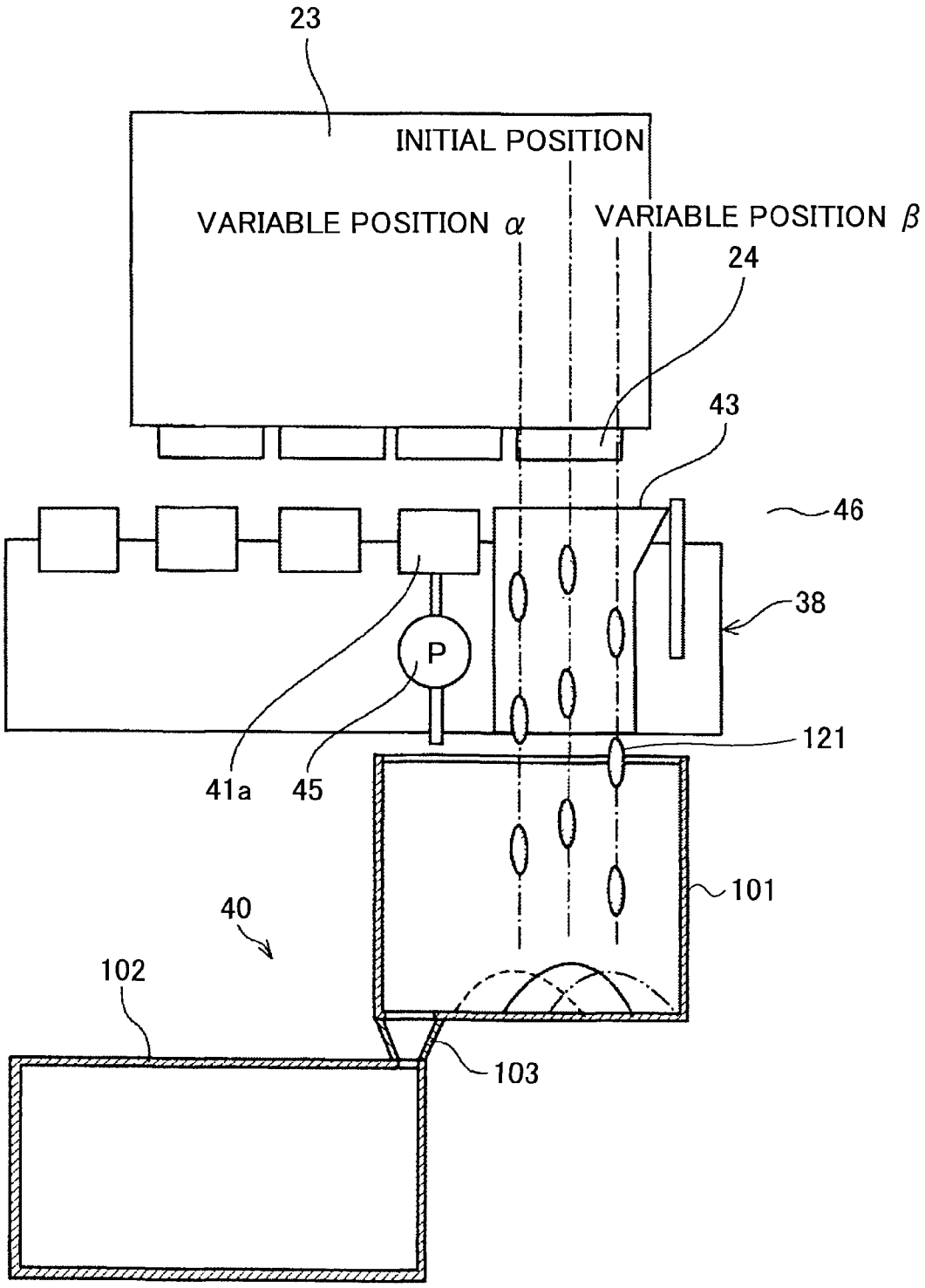
FIG. 25 is a schematic diagram for describing an example of a blank ejection position changing operation according to an embodiment of the present invention.

Next, as one example of the waste liquid discharge position changing operation according to an embodiment of the present invention, a blank ejection position changing operation is described with reference to FIG. 25.

In a case of changing a blank ejection position according to a predetermined threshold, the carriage 23 is controlled to stop at a suitable position. The stopping position of the carriage 23 is controlled according to data of the waste liquid (waste ink) accumulated in the first container 101 of the waste liquid container 40. For example, the carriage 23 stops at a position where waste liquid is discharged (dropped) on an area where the height of the waste liquid is lowest. By preventing waste liquid from being discharged onto a single area in the first container 101, waste liquid can be prevented from accumulating in a single area of the first container 101. Accordingly, the first container 101 of the waste liquid container 40 can be efficiently used.

Figure 26:
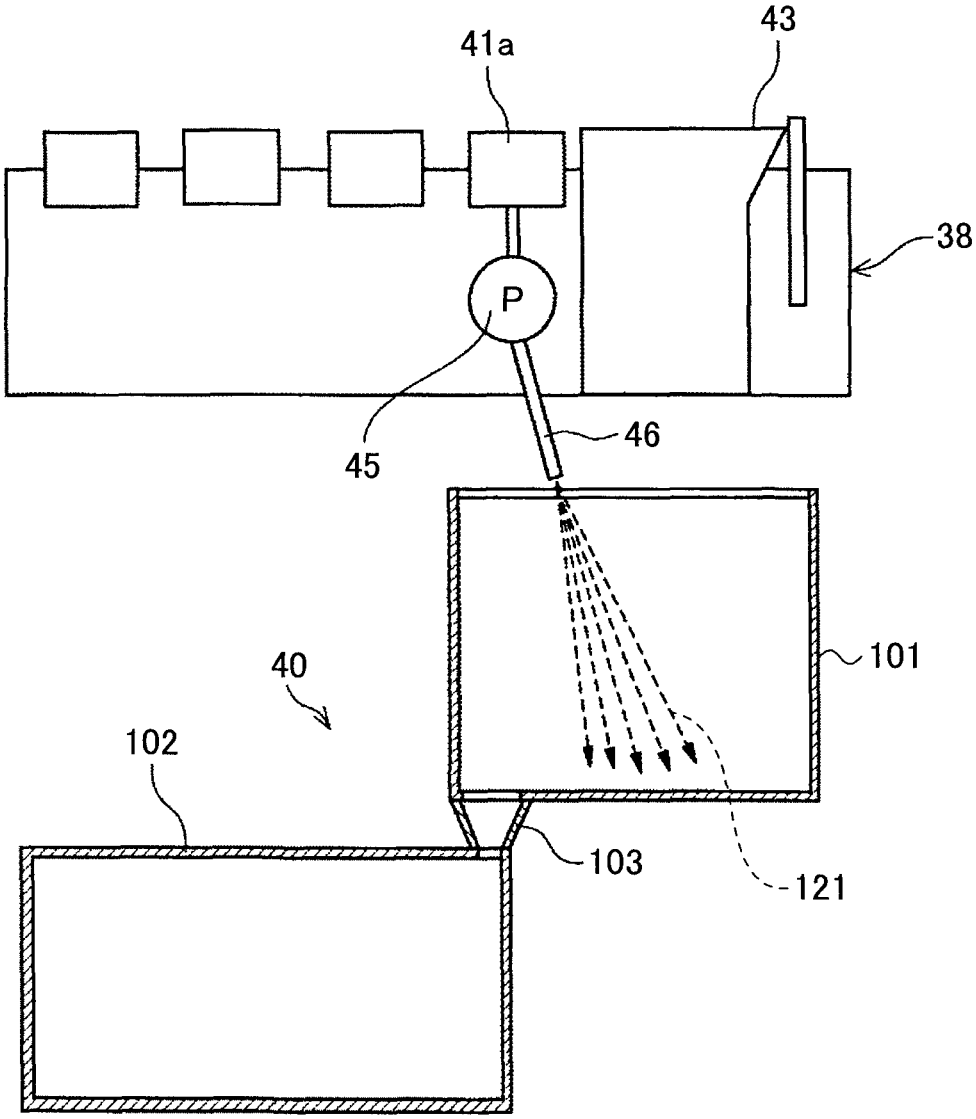
FIG. 26 is a schematic diagram for describing another example of a blank ejection position changing operation according to an embodiment of the present invention.

As another example of the waste liquid discharge position changing operation according to an embodiment of the present invention, an operation of changing a discharge position of the discharge tube 46 (discharge tube position changing operation) is described with reference to FIG. 26.

In this example, a distal end of a discharging part of the discharge tube 46 is inclined toward the first container 101 of the waste liquid container 26. By changing the rotational speed of the absorbing pump motor 47 that drives the absorbing pump 45, the discharge rate of the waste liquid 121 is changed, to thereby change the landing area (impact area) of the discharged waste liquid 121. By preventing waste liquid 121 from being discharged onto a single area in the first container 101, waste liquid can be prevented from accumulating in a single area of the first container 101. Accordingly, the first container 101 of the waste liquid container 40 can be efficiently used. In addition, changing of the discharge position can be achieved with a simple configuration in which the discharge tube 46 is inclined (tilted) at a suitable angle.

Figure 27:
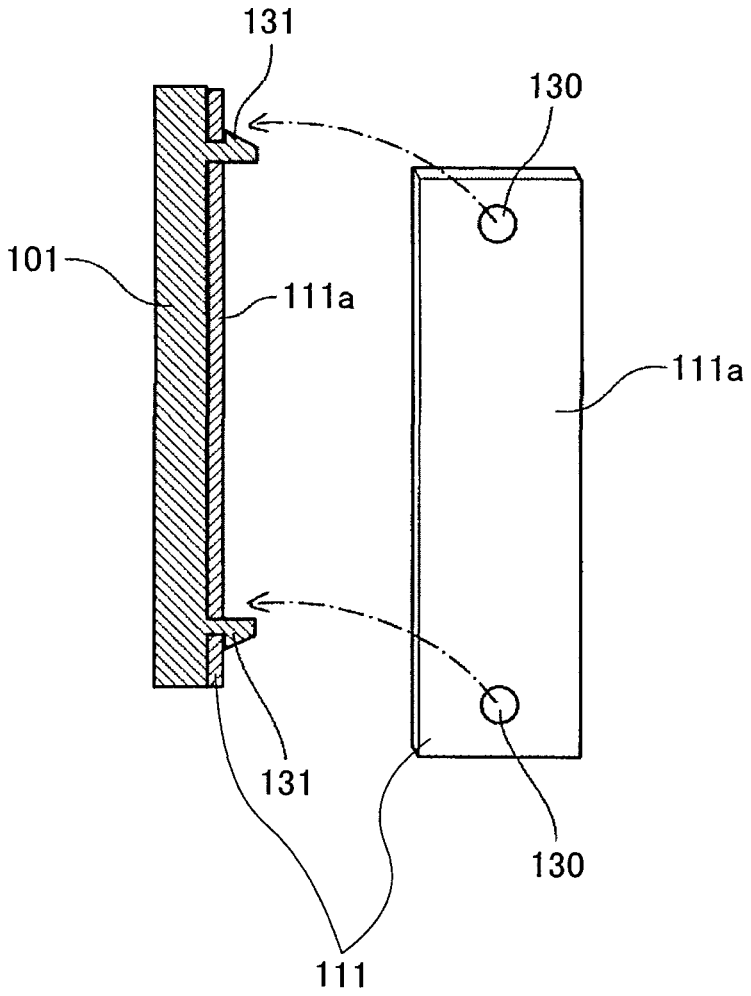
FIG. 27 is a schematic diagram showing a detachable attachment structure of a sensor electrode of a first sensor according to a sixth embodiment of the present invention.

Next, the waste liquid container 40 according to a sixth embodiment of the present invention is described in detail with reference to FIG. 27. FIG. 27 is a schematic diagram showing a detachable attachment structure of the sensor electrode 111*a* of the first sensor 111 according to an embodiment of the present invention.

In this example, the sensor electrode 111*a* included in the first sensor 111 is formed as a thin film. The sensor electrode 111*a* is formed of a conductive material such as aluminum, copper, nickel, or iron. Although the sensor electrode 111*a* may be fixed to the first container 101 by using an adhesive agent or double-faced tape, it is preferable to detachably attach the sensor electrode 11*a* to the first container 101 by providing claws 131 at the sidewall of the first container 101 and inserting the claws 131 into corresponding holes 130 formed in the sensor electrode 111*a*. Although not shown in FIG. 27, the sensor electrode provided in the second sensor 112 may be configured in the same manner as the first sensor 111.

Since the sensors 111, 112 are detachable from the waste liquid container 40, the waste liquid container 40 and the sensors 111, 112 can contribute to recycling.

Figure 28:
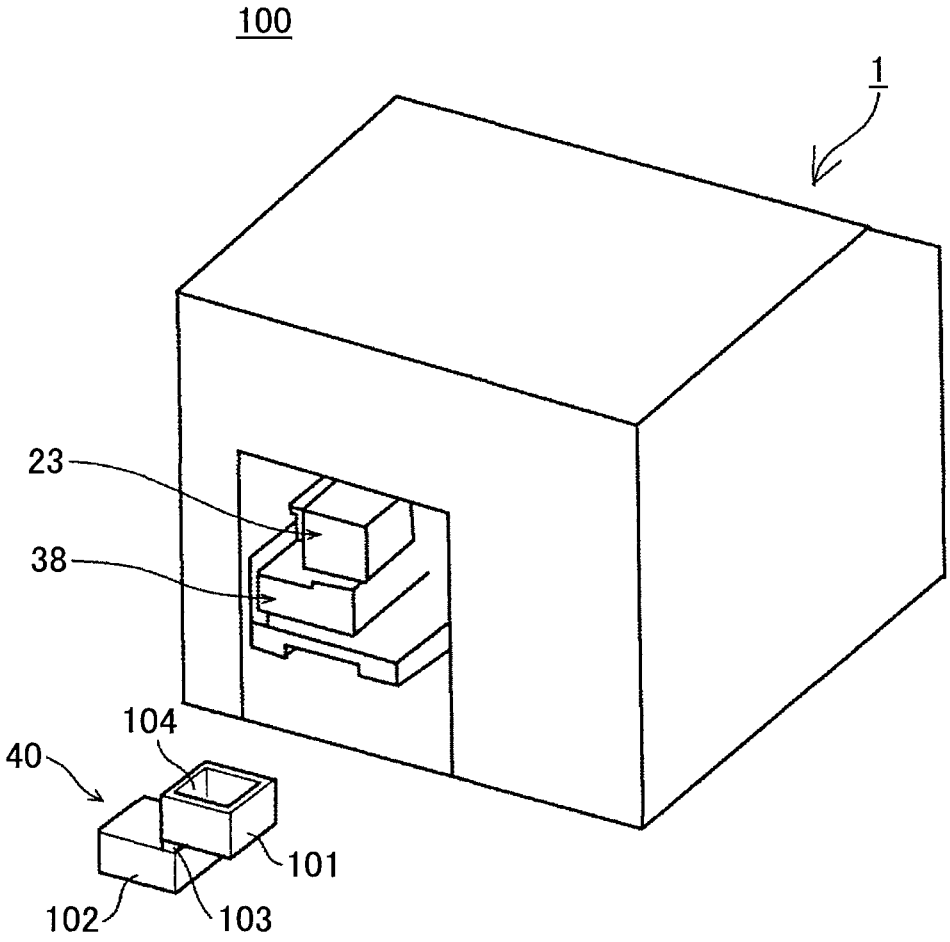
FIG. 28 is a perspective view showing a detachable attachment structure of a waste liquid container according to an embodiment of the present invention.
Figure 29:
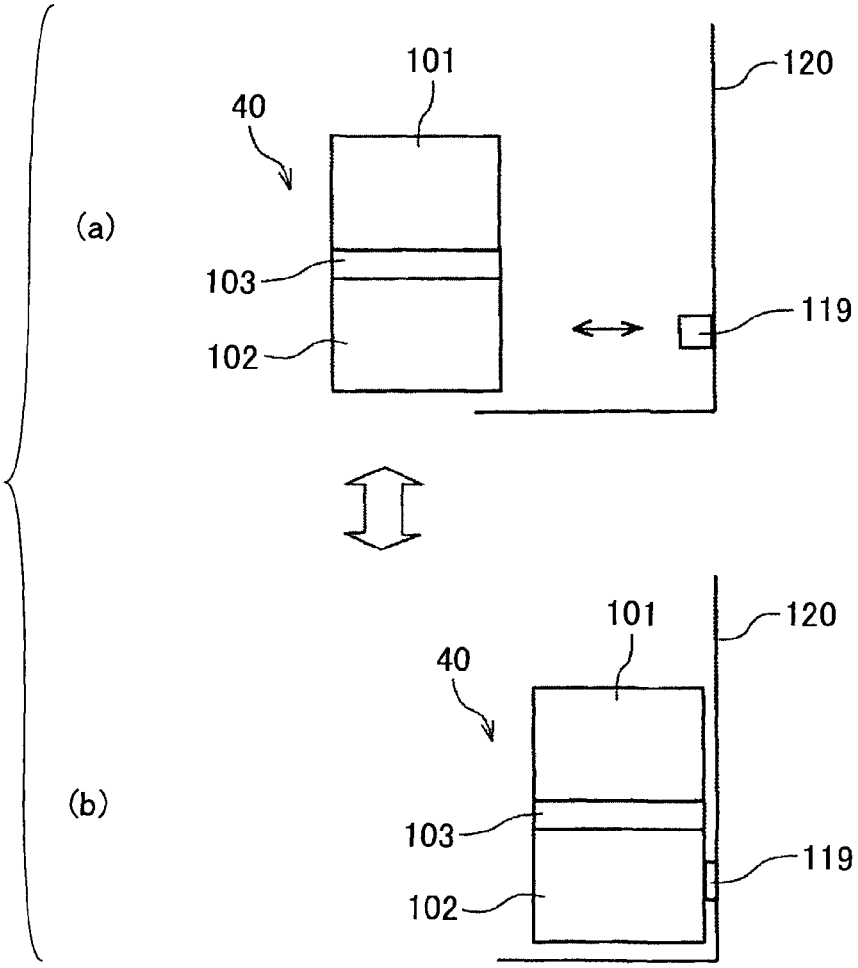
FIG. 29 is a schematic diagram showing a mounting (attaching) part of a waste liquid container according to an embodiment of the present invention.

Next, the image forming apparatus 100 according to another embodiment of the present invention is described with reference to FIGS. 28 and 29. FIG. 28 is a perspective view showing a detachable attachment structure of the waste liquid container 40 according to an embodiment of the present invention. FIG. 29 is a schematic diagram showing a mounting (attaching) part of the waste liquid container 40 according to an embodiment of the present invention.

The waste liquid container 40 can be removed out from the main body 1 of the image forming apparatus 100 by removing an outer cover part provided at the back of the main body 1. As shown in FIG. 29, a tank detection sensor 119 is provided to an attachment part 120 provided inside the main body 1 for detecting the presence of the waste liquid container 40.

Figure 30:
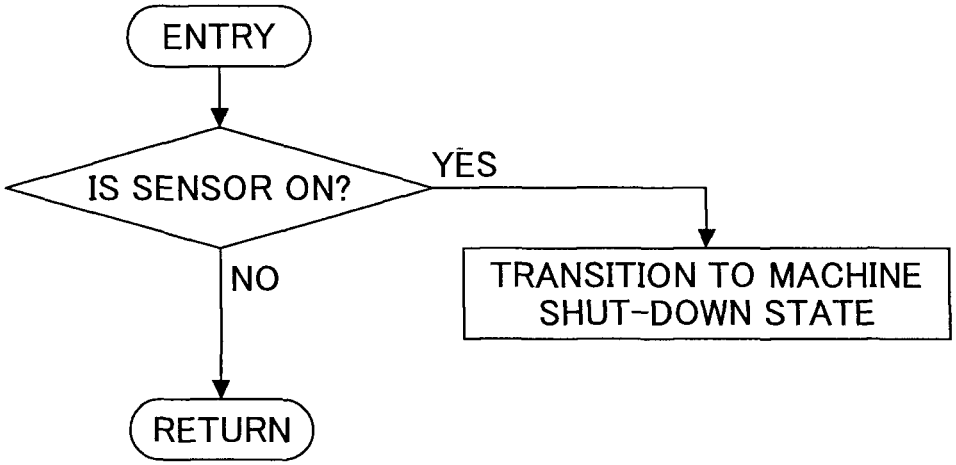
FIG. 30 is a flowchart showing a tank detecting operation according to an embodiment of the present invention.

As shown in FIG. 30, the main control part 201 determines whether the tank detection sensor 119 is "on". The tank detection sensor 119 is "on" when the waste liquid container 40 is detached from the attachment part 120. In a case where the waste liquid container 40 is removed (i.e. detached from the attachment part 120), the image forming apparatus 100 shifts to a shut-down state.

Since the waste liquid container 40 (including the first container 101 or the second container 102) is detachable from the main body 1 of the image forming apparatus 100 according to the above-described embodiment of the present invention, the waste liquid container 40 can be re-attached after eliminating stored waste liquid or replaced with a new waste liquid container. This facilitates maintenance of the image forming apparatus 100. Furthermore, since the presence of the waste liquid container 40 can be detected, waste liquid can be prevented from being erroneously discharged in a state where the waste liquid container 40 is not attached to the image forming apparatus 100. Accordingly, the surrounding of the waste liquid container 40 can be prevented from being stained by waste liquid.

Although the above-described embodiments of the present invention is described by using an exemplary configuration of a copy machine (apparatus having a copying function), the above-described embodiments of the present invention can also be applied to an apparatus having, for example, a printer function or a facsimile function.

The present invention is not limited to the specifically disclosed embodiments, and variations and modifications may be made without departing from the scope of the present invention.

The present application is based on Japanese Priority Application No. 2007-184044 filed on Jul. 13, 2007, with the Japanese Patent Office, the entire contents of which are hereby incorporated herein by reference.

What is claimed is:

1. A waste liquid container for storing a waste liquid discharged from an image forming apparatus, the waste liquid container comprising:

a first container having a single waste liquid inlet into which the waste liquid enters; and a first sensor for detecting the waste liquid inside the first container;

wherein the first sensor includes a first capacitance type sensor having a first pair of sensor electrodes provided in parallel at oppositely facing outer sidewalls of the first container, wherein the first pair of sensor electrodes is provided on the entire sidewall of the first container, with respect to a height direction of the first container, and wherein a plurality of the first sensors are provided and distributed on the sidewall of the first container, and wherein the plurality of the first sensors are configured to detect three-dimensionally the shape and the peak of the waste liquid accumulated in the first container.

2. The waste liquid container as claimed in claim 1, wherein the first sensor is provided in a plurality of areas of the first container.

3. An image forming apparatus comprising:

an image forming part for performing image formation;

a discharging part for discharging a waste liquid that does not contribute to image formation; and a waste liquid container for storing the waste liquid discharged from the discharging part, the waste liquid container including a first container having a single waste liquid inlet into which the waste liquid enters, a first sensor for detecting the waste liquid inside the first container, wherein the first sensor includes a first capacitance type sensor having a first pair of sensor electrodes provided in parallel at oppositely facing outer sidewalls of the first container, wherein the first pair of sensor electrodes are provided on the entire sidewall of the first container, with respect to a height direction of the first container, and wherein the discharging part is configured to change a position for discharging the waste liquid according to the detection result from the first sensor.

4. The image forming apparatus as claimed in claim 3, further comprising another discharging part for performing blank ejection of the waste liquid, wherein the discharging part is configured to change a position for discharging the waste liquid according to the detection result from the first sensor.

5. The image forming apparatus as claimed in claim 4, wherein the other discharging part is a discharge tube.

6. The image forming apparatus as claimed in claim 5, wherein the discharge tube is inclined with respect to the waste liquid inlet.

7. A waste liquid container for storing a waste liquid discharged from an image forming apparatus, the waste liquid container comprising:

a first container having a single waste liquid inlet into which the waste liquid enters; and a first sensor for detecting the waste liquid inside the first container;

wherein the first sensor includes a first capacitance type sensor having a first pair of sensor electrodes provided in parallel at oppositely facing outer sidewalls of the first container, wherein the first pair of sensor electrodes is provided on the entire sidewall of the first container with respect to a height direction of the first container, and wherein a plurality of the first sensors are provided and distributed on the sidewall of the first container, and wherein the plurality of the first sensors are configured to detect three-dimensionally the shape and the peak of the waste liquid accumulated in the first container.

* * * * *